US011432639B2

(12) United States Patent
Wold et al.

(10) Patent No.: US 11,432,639 B2
(45) Date of Patent: Sep. 6, 2022

(54) VERSATILE SLING SYSTEM, APPARATUS AND HUB

(71) Applicant: LifeHandle, LLC, Casper, WY (US)

(72) Inventors: Joseph S. Wold, Roslindale, MA (US); Brendan Truscott, West Roxbury, MA (US)

(73) Assignee: LifeHandle, LLC, Casper, WY (US)

( * ) Notice: Subject to any disclaimer, the term of this patent is extended or adjusted under 35 U.S.C. 154(b) by 0 days.

(21) Appl. No.: 17/179,185

(22) Filed: Feb. 18, 2021

(65) Prior Publication Data

US 2021/0251371 A1 Aug. 19, 2021

Related U.S. Application Data

(63) Continuation-in-part of application No. 29/751,815, filed on Sep. 23, 2020, and a continuation-in-part of (Continued)

(51) Int. Cl.

| | |
|---|---|
| ***A45F 3/14*** | (2006.01) |
| ***A47D 13/02*** | (2006.01) |
| ***A45F 3/00*** | (2006.01) |

(52) U.S. Cl.

CPC ..... *A45F 3/14* (2013.01); *A45F 2003/003* (2013.01); *A45F 2003/142* (2013.01); *A47D 13/025* (2013.01)

(58) Field of Classification Search

CPC ... A45F 3/14; F16B 7/20; F16B 21/04; Y10T 403/7007

(Continued)

(56) References Cited

U.S. PATENT DOCUMENTS 2,873,902 A * 2/1959 Decker ..... F41C 33/007 224/257
3,973,643 A * 8/1976 Hutchinson ..... A62B 35/0006 182/3

(Continued)

FOREIGN PATENT DOCUMENTS

CN 202110192254.8 2/2021

OTHER PUBLICATIONS

U.S. Appl. No. 29/722,917, filed Feb. 3, 2020.

(Continued)

*Primary Examiner* — Nathan J Newhouse
*Assistant Examiner* — Lester L Vanterpool
(74) *Attorney, Agent, or Firm* — Cooley LLP

(57) ABSTRACT

The disclosure relates to a versatile sling system, apparatus and hub, the apparatus and system comprising a strap having a first end, a second end, a width, and an adjustable length, the first end of the strap and the second end of the strap being coupled such that the strap forms a loop; and a hub coupled to the strap such that the hub is suspended from the loop. The hub of the apparatus is configured to releasably attach at least one accessory, such as a handle or leash; the system configured to allow the wearer of the strap to transfer at least a portion of the weight and/or force of an item or animal being carried by the wearer and/or attached to the at least one accessory to the torso and shoulder of the wearer. The disclosure further relates to accessories compatible with the hub.

21 Claims, 32 Drawing Sheets

Related U.S. Application Data application No. 29/758,344, filed on Nov. 13, 2020, and a continuation-in-part of application No. 29/770,961, filed on Feb. 18, 2021.

(60) Provisional application No. 62/978,325, filed on Feb. 19, 2020.

(58) Field of Classification Search
USPC ..... 224/257, 607; 403/349, 348
See application file for complete search history.

(56) References Cited

U.S. PATENT DOCUMENTS 4,976,388 A * 12/1990 Coontz ..... A45C 13/30 224/150
5,409,151 A * 4/1995 Freimark ..... A45F 3/16 215/228
5,425,485 A * 6/1995 Carlo ..... A45F 3/14 224/250
5,464,136 A * 11/1995 Eddy ..... A45F 5/021 224/666
5,586,969 A * 12/1996 Yewer, Jr. ..... A61F 5/028 128/101.1
5,941,438 A * 8/1999 Price ..... A41F 9/002 224/662
6,315,179 B1 * 11/2001 Hillis ..... A45F 3/14 224/200
6,378,746 B1 * 4/2002 Miller ..... A45F 3/14 224/158
6,446,849 B1 * 9/2002 Schleifer ..... A43B 5/0425 224/258
7,334,714 B2 * 2/2008 Brown ..... A45C 13/30 224/600
7,798,137 B2 * 9/2010 Ewing ..... F41B 5/1461 124/86
7,942,294 B2 * 5/2011 Burton ..... A45F 3/14 224/257
10,244,851 B1 * 4/2019 Petersson ..... A45F 3/02
11,044,985 B2 * 6/2021 Swaggart ..... A45C 13/30
2004/0094586 A1 * 5/2004 MacAllister ..... A45F 3/14 224/258
2006/0108387 A1 * 5/2006 Nakaya ..... A01D 34/90 224/254
2008/0029564 A1 * 2/2008 Wong ..... A63B 47/00 224/600
2008/0203127 A1 * 8/2008 Castillo-Garrison ..... A45F 5/02 224/607
2009/0266862 A1 * 10/2009 Price ..... A45F 3/14 224/600
2012/0061439 A1 * 3/2012 Wallis ..... A45F 5/00 224/600
2012/0260865 A1 * 10/2012 Nesper ..... A01K 27/00 119/792
2013/0101784 A1 * 4/2013 Henry ..... A45F 3/14 428/99
2014/0331944 A1 * 11/2014 Chirico ..... A01K 15/02 119/797
2014/0361059 A1 * 12/2014 Fuller, Sr. ..... A45F 5/00 224/267
2016/0050906 A1 * 2/2016 Owen ..... A45F 3/14 24/3.13
2016/0338473 A1 * 11/2016 Clews ..... A45C 13/30
2017/0064928 A1 * 3/2017 Seuk ..... A01K 27/003
2017/0164721 A1 * 6/2017 Forney ..... A45C 13/30
2017/0360009 A1 * 12/2017 Anderson ..... A45F 3/02
2018/0031350 A1 * 2/2018 Rohel ..... A45F 3/14
2018/0213920 A1 * 8/2018 Uzomba ..... A45F 3/14

OTHER PUBLICATIONS

"EEEKit 2 Packs Carry Bag for 30 Oz Tumbler, Yeti, Ozark, . . . Shoulder String," Amazon.com, retrieved from URL <https://www.amazon.com/EEEKit-Tumbler-Adjustable-Detachable-Shoulder/dp/BO1N1TCOKS/ref=sr_1_5?dchild=1&keywords=eeekit+cup+holder&qid...>, Dec. 28, 2020, 7 pages.

"Yeti Small Bottle Sling for Rambler 18 oz. Bottle, Charcoal," Amazon.com, retrieved from URL <https://www.amazon.com/YETI-Small-Bottle-Rambler-Charcoal/dp/B0842BLCLV/ref=sr_1_1?dchild=1&keywords=yeti+sling&qid=1609175930&sr=8-1>, Dec. 28, 2020, 6 pages.

Geartac Systems, "Geartrek," retrieved from URL <https://geartac.com/products/geartrek-hands-free-dog-walking-device-leash>, 2020, 4 pages.

Moby, "Moby Ring Sling—Double Gauze—Rose," retrieved from URL <https://mobywrap.com/products/moby-ring-sling-double-gauze-rose>, 2020, 10 pages.

Store Your Board, "Ski Backpack Carry Straps | Mountain Goat Tote," retrieved from URL <https://www.storeyourboard.com/ski-carrier-straps-ski-tote-backpack/>, Dec. 28, 2020, 3 pages.

* cited by examiner

SECTION A-A

VERSATILE SLING SYSTEM, APPARATUS AND HUB

CROSS REFERENCE TO RELATED APPLICATIONS

The current application claims the benefit of and priority to U.S. Provisional Application Ser. No. 62/978,325, titled "WEIGHT DISTRIBUTING HARNESS SYSTEM", filed on Feb. 19, 2020, is a continuation-in-part of U.S. Design application Ser. No. 29/751,815, titled "ATTACHABLE CONTAINER HOLDER", filed Sep. 23, 2020, is a continuation-in-part of U.S. Design application Ser. No. 29/758,344, titled "WEIGHT DISTRIBUTING HARNESS SYSTEM", filed Nov. 13, 2020, and is a continuation-in-part of U.S. Design application Ser. No. 29/770,961, titled "ATTACHABLE CONTAINER HOLDER", filed Feb. 18, 2021, which are hereby incorporated by reference in their entirety.

FIELD

The disclosure relates to a versatile sling system, apparatus, and hub configured to be attached to one or more accessories, thereby transferring a portion of the weight and/or force of the item or animal being carried and/or attached to the accessory to the torso and shoulder of the wearer.

BACKGROUND

Carrying a child or heavy items in your arms for long periods of time can cause fatigue and back pain. Traditional systems to transfer the weight and assist in carrying heavy items or children are often bulky and cumbersome to wear. Moreover, they take time to get in and out of, as they comprise multiple straps which must be adjusted for proper fit, and then fastened securely to the wearers body. These devices are also typically limited to a maximum size or weight, and traditionally designed only for a single purpose.

The foregoing examples of related art and limitations related therewith are intended to be illustrative and not exclusive, and they do not imply any limitations on the disclosure presented herein. Other limitations of the related art will become apparent to those skilled in the art upon a reading of the specification and a study of the drawings.

SUMMARY

The following embodiments and aspects thereof are described and illustrated in conjunction with systems, tools and methods, which are meant to be exemplary and illustrative, not limiting in scope.

In some embodiments, the disclosure teaches a system comprising a strap having a first end, a second end, a width, and an adjustable length, the first end of the strap and the second end of the strap being coupled such that the strap forms a loop; a hub coupled to the strap such that the hub is suspended from the loop, the hub configured to releasably attach at least one accessory to the hub; and at least one accessory, the at least one accessory characterized by a handle and/or a leash configured to attach to the hub; the system configured to allow the wearer of the strap to transfer at least a portion of the weight and/or force of an item or animal being carried by the wearer and/or attached to the at least one accessory to the torso and shoulder of the wearer. In some embodiments, the hub, the first end of the strap, and the second end of the strap are coupled by a substantially circular shaped ring. In some embodiments, the strap includes an attachment system coupled to the strap, the attachment system including at least one of a loop, ring, button, hook-and-loop fastener, and/or zipper. In some embodiments, the hub comprises a proximal end, the proximal end suspended from the loop; a distal end, the distal end having a recess configured to receive an accessory having a protrusion with a plurality of teeth extending from the outer perimeter of the protrusion; and a middle, the middle comprising a locking mechanism, wherein the locking mechanism retains an accessory to the hub by a rotatable element that encircles the protrusion below the plurality of teeth. In some embodiments, the strap is constructed of a flexible material, the flexible material including a fabric, leather, nylon, rope, plastic, and/or combinations thereof. In some embodiments, the handle includes a rod, loop, hook, clip, carabiner, or combinations thereof. In some embodiments, the strap is incorporated into a garment.

In some embodiments, the disclosure teaches an apparatus, comprising a strap having a first end, a second end, a width, and an adjustable length, the first end of the strap being coupled to the second end of the strap to form a loop; and a hub having a proximal end and a distal end, the proximal end of the hub being coupled to the strap such that the hub is suspended from the loop, the distal end of the hub configured to be releasably attached to an accessory. In some embodiments, the hub further comprises a locking mechanism. In some embodiments, the strap comprises: a first elongate flexible member having a length, a width, an outer surface, and an inner surface, and a second elongate flexible member having a length, a width, an outer surface and an inner surface, the width of the second elongate flexible member being less than the width of the first elongate flexible member, and wherein the second elongate member is coupled to the outer surface of the first elongate flexible member to form a plurality of loops. In some embodiments, the second elongate flexible member is coupled to the outer surface of the first elongate flexible member substantially along a centerline of the first elongate flexible member. In some embodiments, the first elongate flexible member is padded. In some embodiments, the strap is constructed of fabric, leather, nylon, rope, plastic, and/or combinations thereof. In some embodiments, the first end of the strap, the second end of the strap, and the hub, are coupled by a substantially circular shaped ring. In some embodiments, the maximum width of the strap is approximately 5 inches and the minimum width of the strap is approximately 2 inches. In some embodiments, the strap includes an attachment system coupled to the strap, the attachment system including at least one of a loop, ring, button, hook-and-loop fastener, and/or zipper. In some embodiments, the length of the strap is adjustable via at least one buckle.

In some embodiments, the disclosure teaches a hub, comprising a proximal end, the proximal end configured to allow coupling to a first object; a distal end, the distal end having a recess configured to receive a second object, the second object having a protrusion with a plurality of teeth extending from the outer perimeter of the protrusion; and a middle, the middle comprising a locking mechanism, wherein the locking mechanism retains the second object to the hub via a rotatable element that encircles the protrusion below the plurality of teeth. In some embodiments, the distal end further comprises at least one elongate protrusion. In some embodiments, the outer surface of the distal end and the outer surface of the middle each include at least one notch, wherein the notches are aligned when the hub is in the locked position.

In addition to the embodiments described above, further aspects, examples, and embodiments will become apparent by study of the following descriptions. The summary above is a list of example implementations, not a limiting statement of the scope.

BRIEF DESCRIPTION OF THE DRAWINGS

The accompanying figures, which are incorporated herein and form a part of the specification, illustrate some, but not the only or exclusive, example embodiments and/or features. It is intended that the embodiments and figures disclosed herein are to be considered illustrative rather than limiting.

DETAILED DESCRIPTION

Figure 1:
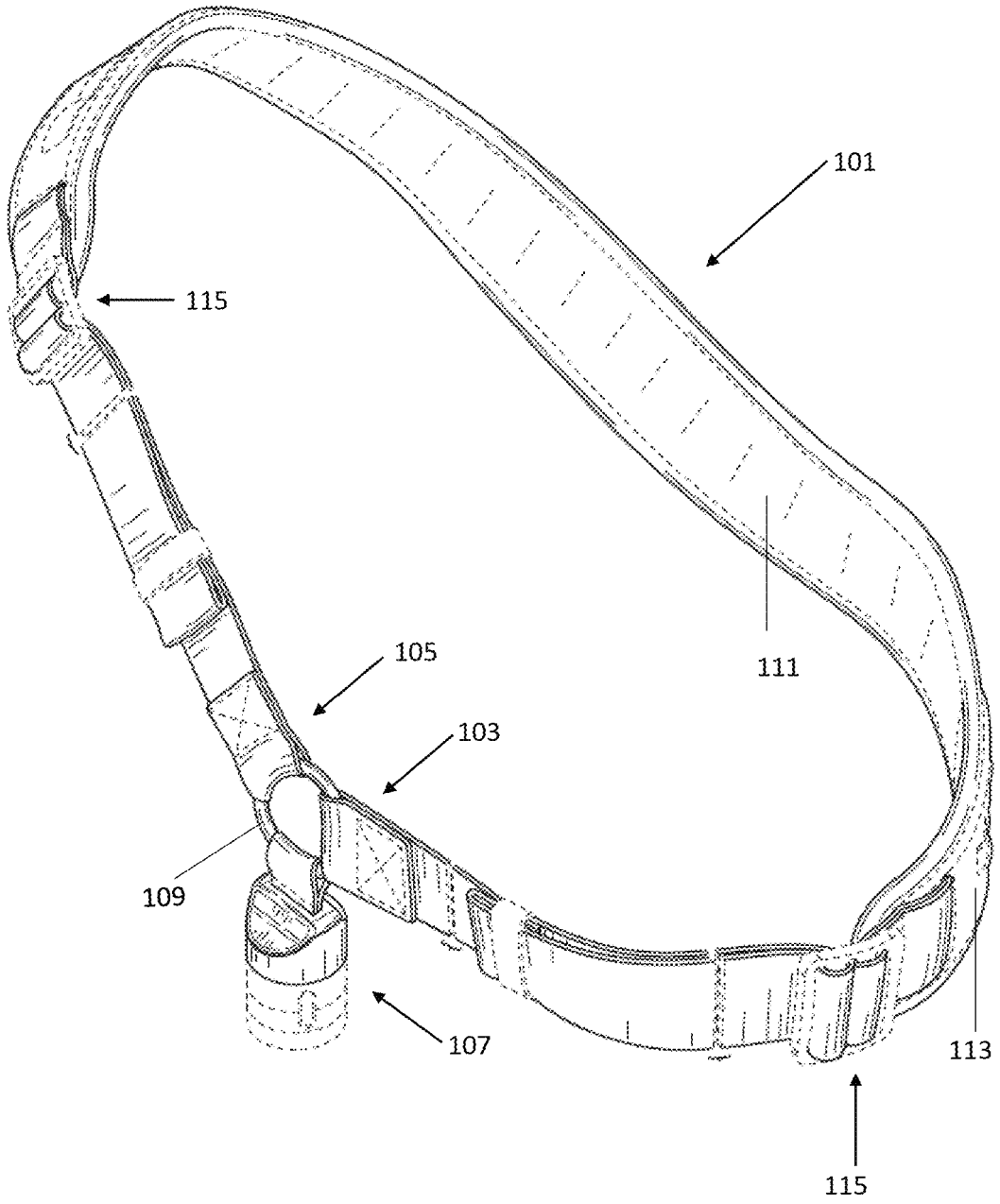
FIG. 1 is a perspective view of a versatile sling, according to an embodiment.

All publications, patents and patent applications referenced herein, including any drawings and appendices, are herein incorporated by reference to the same extent as if each individual publication or patent application was specifically and individually indicated to be incorporated by reference.

The following description includes information that may be useful in understanding the present disclosure. It is not an admission that any of the information provided herein is prior art or relevant to the presently claimed embodiments, or that any publication specifically or implicitly referenced is prior art.

Definitions

As used herein, the verbs "comprise", "includes", and "characterized by" are used in this description and in the claims and its conjugations are used in its non-limiting sense to mean that items following the word are included, but items not specifically mentioned are not excluded.

As used in this specification, the singular forms "a," "an" and "the" include plural referents unless the context clearly dictates otherwise. Thus, for example, the term "a member" is intended to mean a single member or a combination of members, "a material" is intended to mean one or more materials, or a combination thereof. As used herein, the terms "reversible," "reversibly," "removably," and/or the like when used to described a process and/or procedure generally refer to a non-destructive process or procedure that can be subsequently undone by a similar yet substantially opposed, inverse, and/or opposite non-destructive process or procedure. When used herein with respect to attachment and/or detachment of an element or assembly, a reversible or removable attachment refers to a non-destructive, repeatable attachment and/or detachment of the element or assembly.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or there below.

The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially parallel" is intended to convey that, although a parallel geometric relationship is desirable, some non-parallelism can occur in a "substantially parallel" arrangement. By way of another example, a structure defining a diameter that is "substantially 100 millimeters (mm)" is intended to convey that, while the recited diameter is desirable, some tolerances can occur when the volume is "substantially" the recited volume (e.g., 100 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

While numerical ranges may be provided for certain quantities, it is to be understood that these ranges can include all subranges therein. Thus, the range "from 5 to 10" includes all possible ranges therein and all values within a given range may be an endpoint for the range encompassed thereby (e.g., 6-10, 7-10, 8-10, 9-10, 5-9, 6-9, 7-9, 8-9, 5-8, 6-8, 7-8, 6-8, 7-8, 8-9, or fractions thereof).

Overview

Shown in FIG. 1 is a perspective view of a versatile sling 101 according to an embodiment. As shown in FIG. 1, the sling comprises a strap having a first end 103 and a second end 105, a width, an adjustable length (e.g., which can be adjusted via one or more buckles 115), an inner surface 111, and an outer surface 113. The first end 103 and the second end 105 can coupled together via a connector 109 to form a loop. The connector 109 is shown as a circular ring 109. In some embodiments, the first end 103 and/or the second end 105 of the strap are coupled to the connector (e.g., ring 109) such that the first end 103 and/or the second end 105 is moveable with respect to the connector 109. In this manner, the connector 109 enables the position of ends 103, 105 of the sling to be adjustable with respect to each other and/or the connector 109 during use, which in turn can provide an improved fit for comfort and/or weight distribution for the user. A hub 107 can be coupled to the sling 101. For example, as shown in FIG. 1, the hub 107 can be coupled to the connector 109. More specifically, the hub 107 can be coupled to the circular ring 109 such that the hub 107 is suspended from the loop of the sling 101 (e.g., via a strap looped about the ring and coupled to a proximal end portion of the hub 107).

Figure 2:
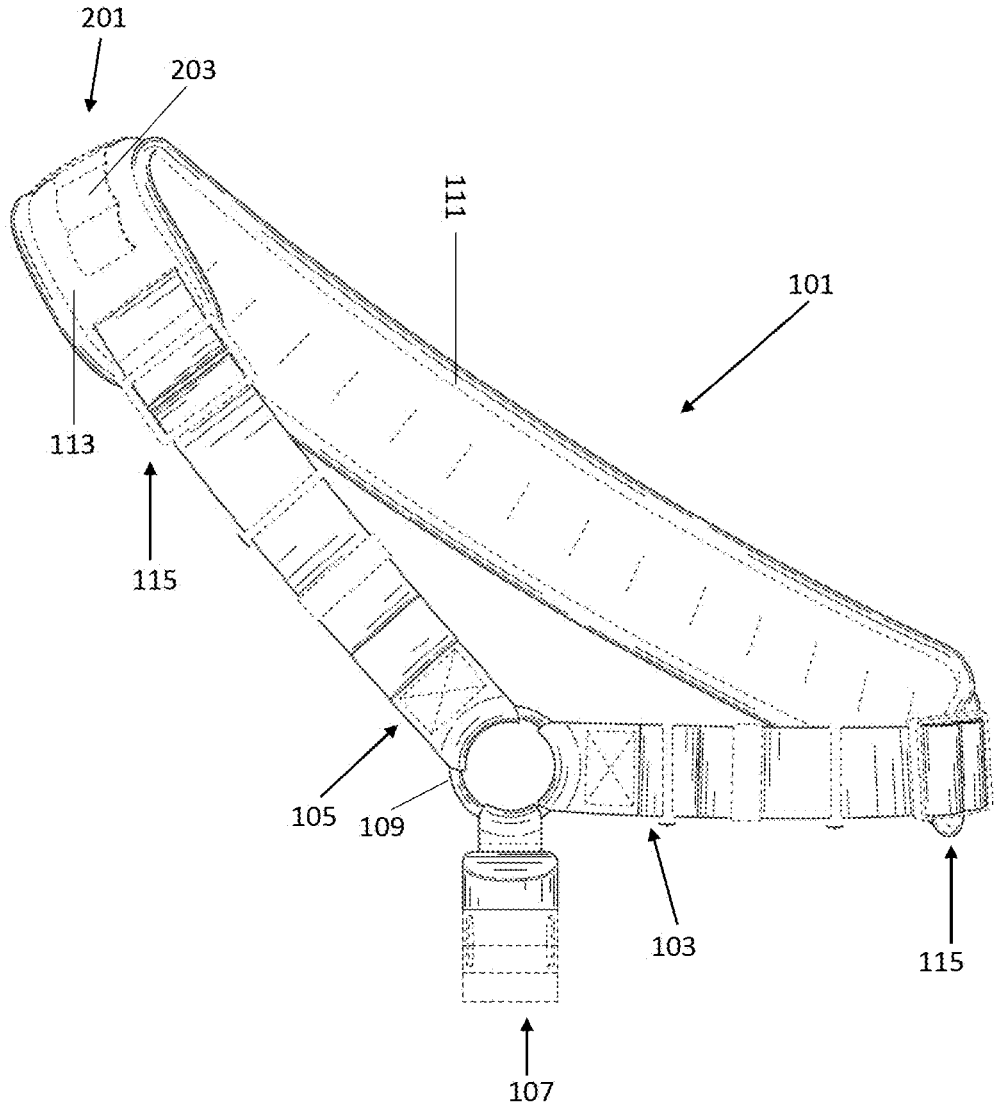
FIG. 2 is a front view of the versatile sling illustrated in FIG. 1.
Figure 3:
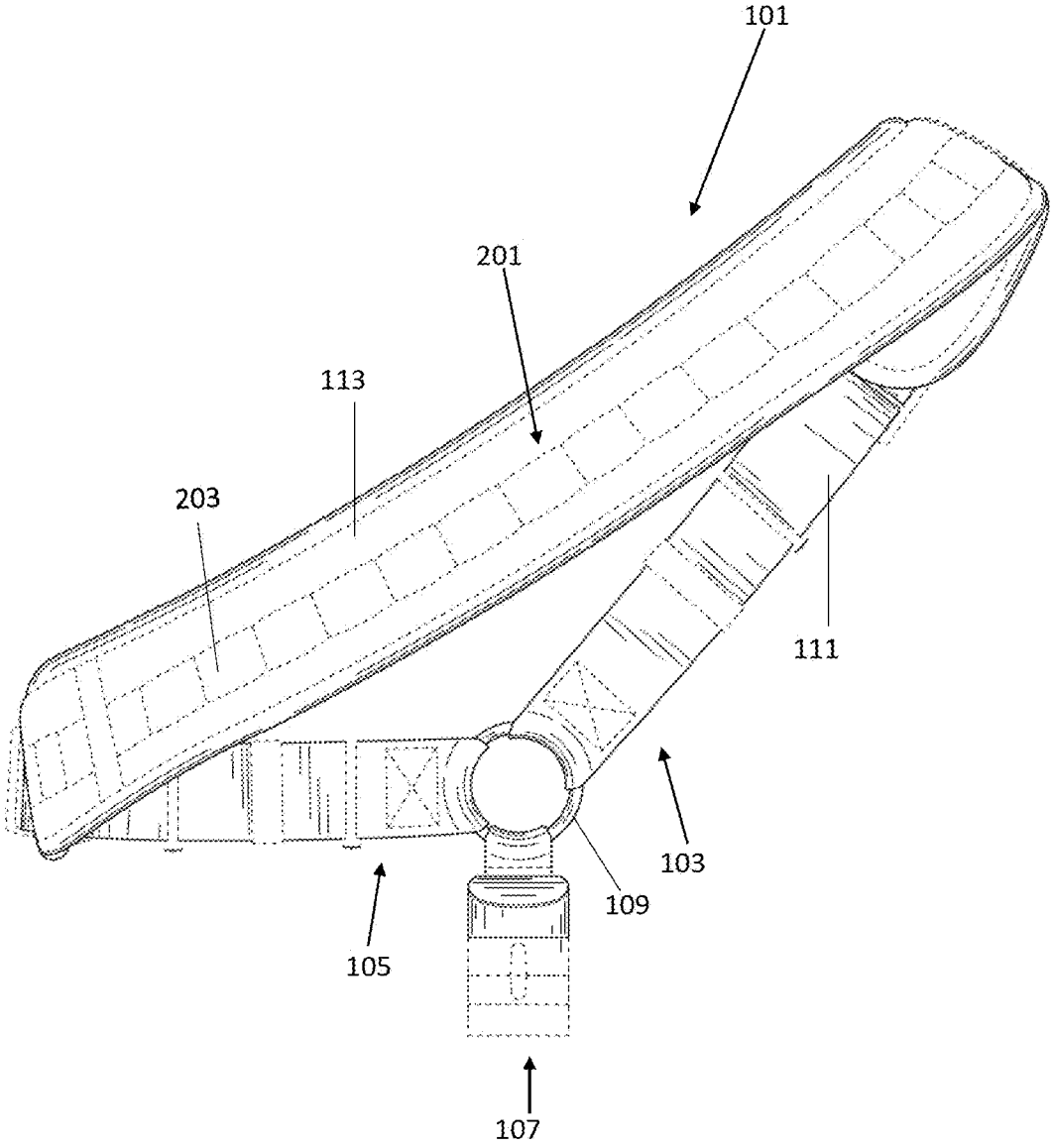
FIG. 3 is a rear view of the versatile sling illustrated in FIG. 1.
Figure 4:
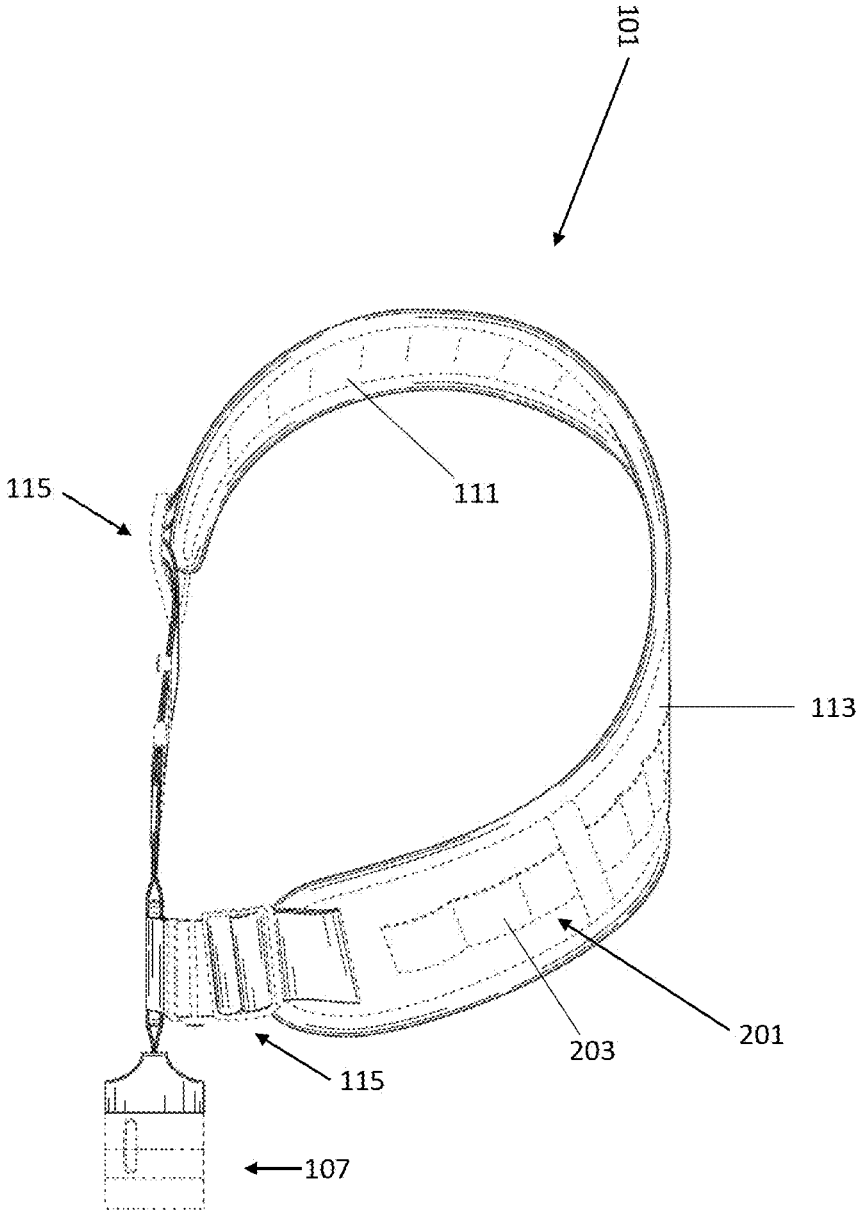
FIG. 4 is a right side view of the versatile sling illustrated in FIG. 1.
Figure 5:
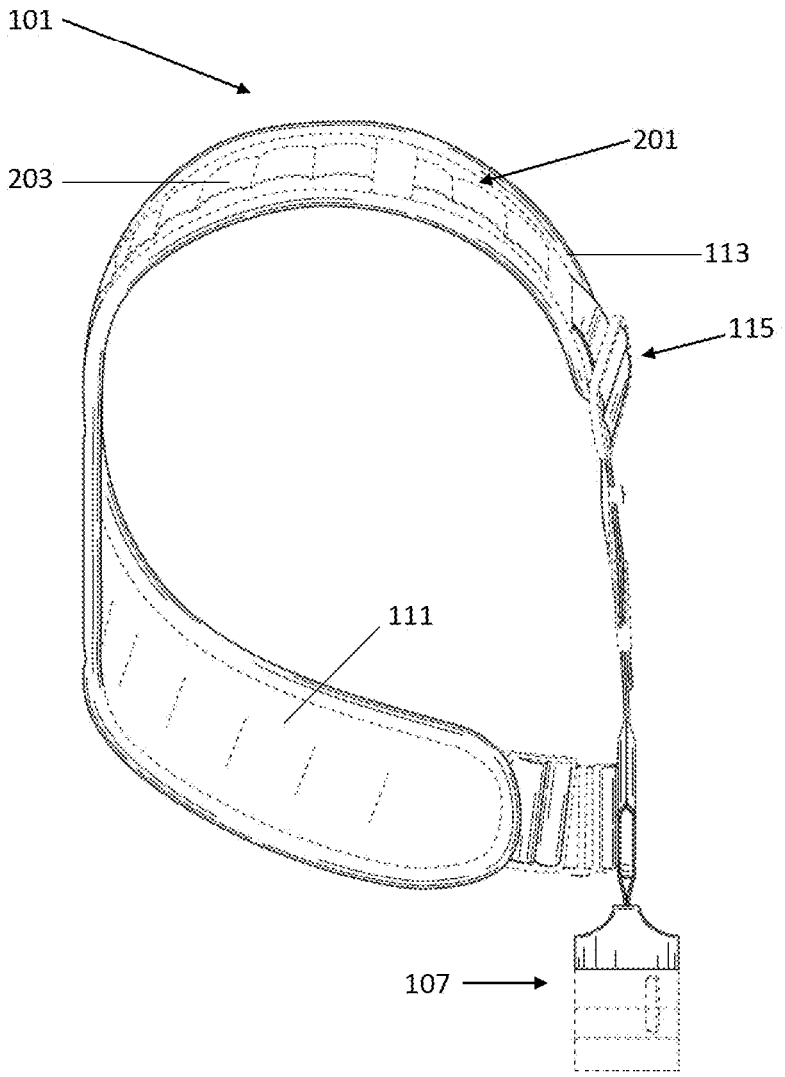
FIG. 5 is a left side view of the versatile sling illustrated in FIG. 1.
Figure 6:
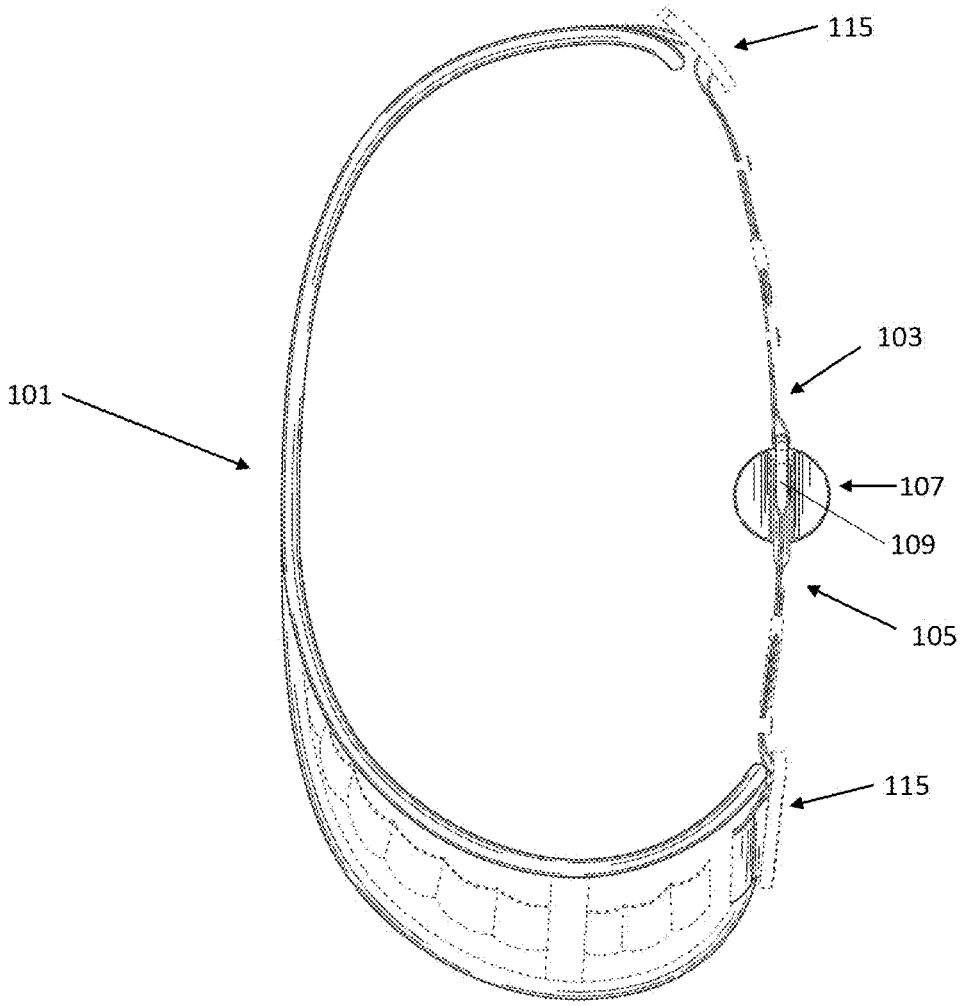
FIG. 6 is a top view of the versatile sling illustrated in FIG. 1.
Figure 7:
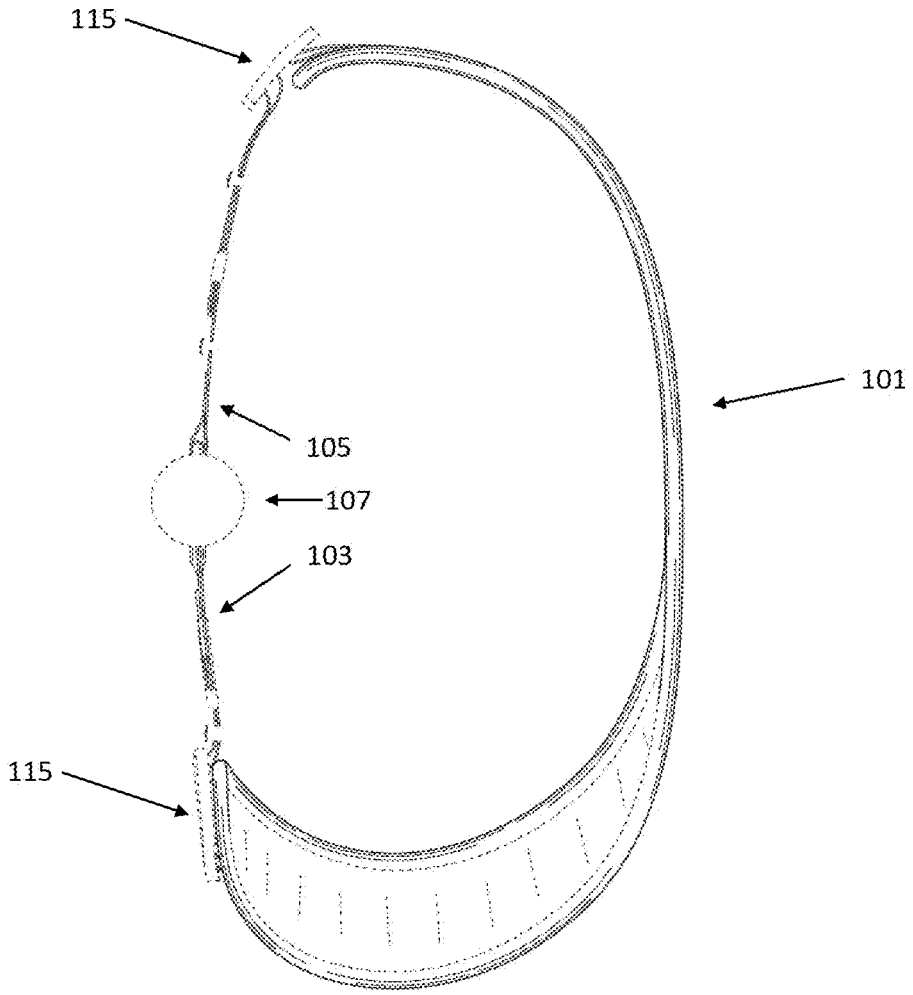
FIG. 7 is a bottom view of the versatile sling illustrated in FIG. 1.

Referring to FIGS. 2 and 3, the versatile sling 101 can include an attachment system comprising a flexible member 201 that is coupled to the outer surface 113 of the versatile sling 107. The flexible member 201 can be coupled, for example, substantially along a centerline of the sling. The flexible member 201 can be coupled to the outer surface 113 via any suitable coupling mechanism, including, but not limited to, stitching, or an adhesive. The stitching of the flexible member 201 can create a series of loops 203 that can be used to attach other items and accessories to the sling 101. Other examples of attachment systems include rings, buttons, hook-and-loop fasteners, and zippers. In some embodiments, the attachment system comprises at least one of a loop, ring, button, hook-and-loop fastener (such as VELCRO®), and/or zipper, or a combination thereof.

The loops 203 of the flexible member 201 can be approximately identical in length along a length of the flexible member 201. In some embodiments, one or more loops 203 has a length different than that of another loop or loops of the series of loops. For example, in some embodiments, one or more loops proximate the center of the series of loops can be longer than (e.g., two, three or four times as long as) a loop proximate a first or second end of the series of loops. The series of loops 203 can include any suitable number of loops, including for example a number in the range of about 2 to 30 loops.

As will be understood by one skilled in the art, a variety of materials may be used to construct the versatile sling 101 including, but not limited to, fabric, leather, nylon, rope, and plastic. In some embodiments, the versatile sling is constructed out of flexible material. In some embodiments, the versatile sling is constructed out of flexible and non-flexible materials. In some embodiments, the sling 101 is padded. In some embodiments, it is padded with rubber, foam rubber, compressed polyester, polyester fiberfill, medium or high density polyurethane foam, open cell foam, closed cell foam, fabric backed sew foam, polyethylene sheet, polyethylene foam, or equivalents thereof. In some embodiments, the versatile sling further comprises reflective and/or waterproof material.

The reflective material may be on the strap, attachment system, hub, and/or accessory item(s) attached to the hub or sling. The reflective material may be comprised of embedded reflective film, sealed reflective film, micro prism reflective film, all prism reflective film, or combinations thereof. The material may comprise fabric, yarn, or trim, and may be woven into the strap, or it may be a reflective coating applied to the hardware on the versatile sling system. The reflective material may be of any color, for example, red, yellow, blue, white, green, orange, or combinations thereof.

Although the connector 109 is shown as a substantially circular ring 109, in some embodiments, the connector 109 can be any suitable shape (or material) configured to couple the first end 103 and the second end 105 of the strap to form a loop and allow movement, including, but not limited to, a D-ring, circle, substantially circular shaped ring, oval, polygon, such as a triangle, rectangle, square, pentagon, hexagon, heptagon, octagon, nonagon, or decagon. Although the first and second ends 103, 105 of the strap are described as being moveable with respect to the connector 109 (e.g., by being looped about the connector via a flexible strap), in some embodiments, one or both of the ends 103, 105 of the strap are fixedly coupled to the connector 109.

Figure 8A:
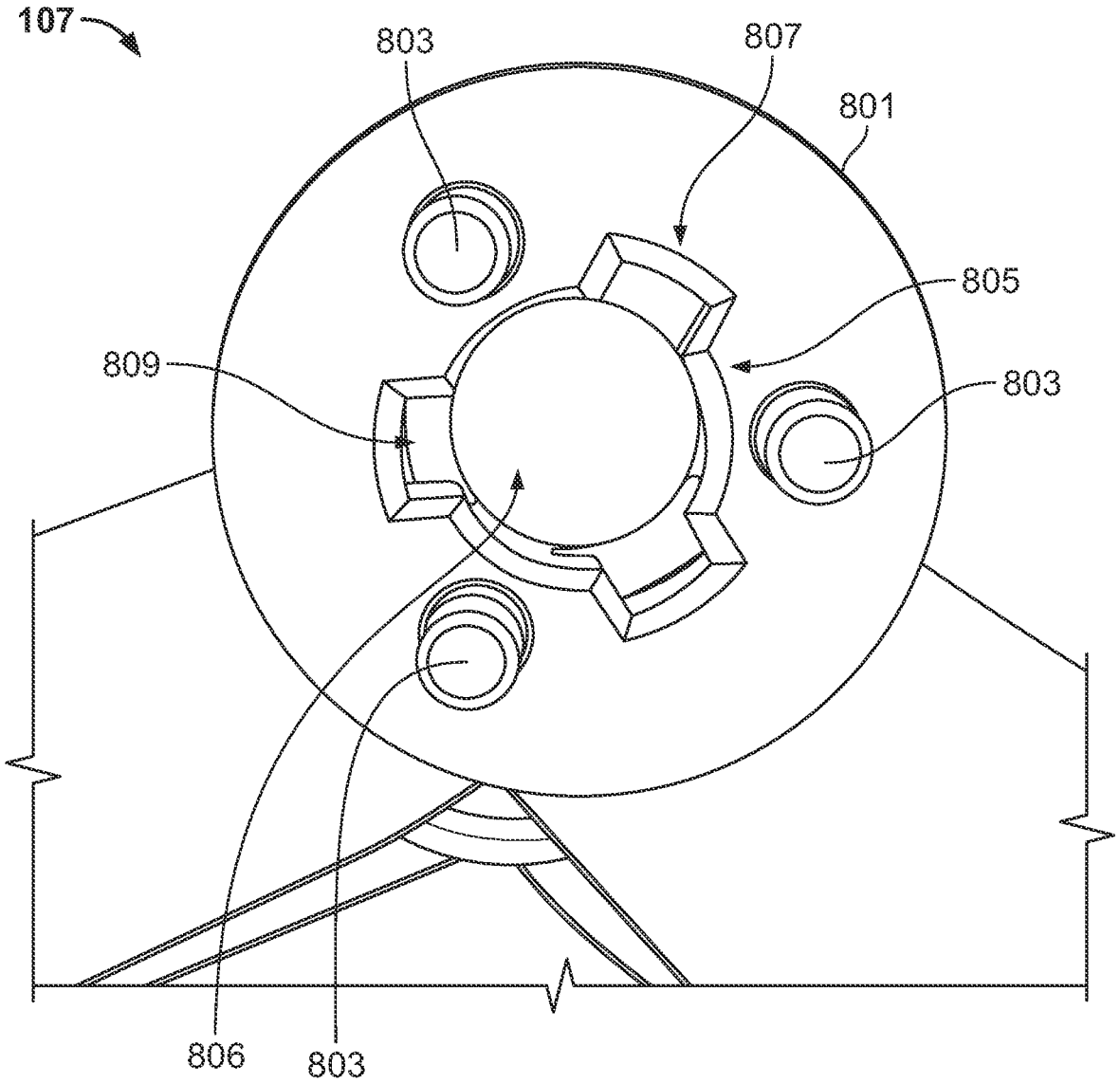
FIG. 8A is a bottom view of the hub in a locked position.
Figure 8B:
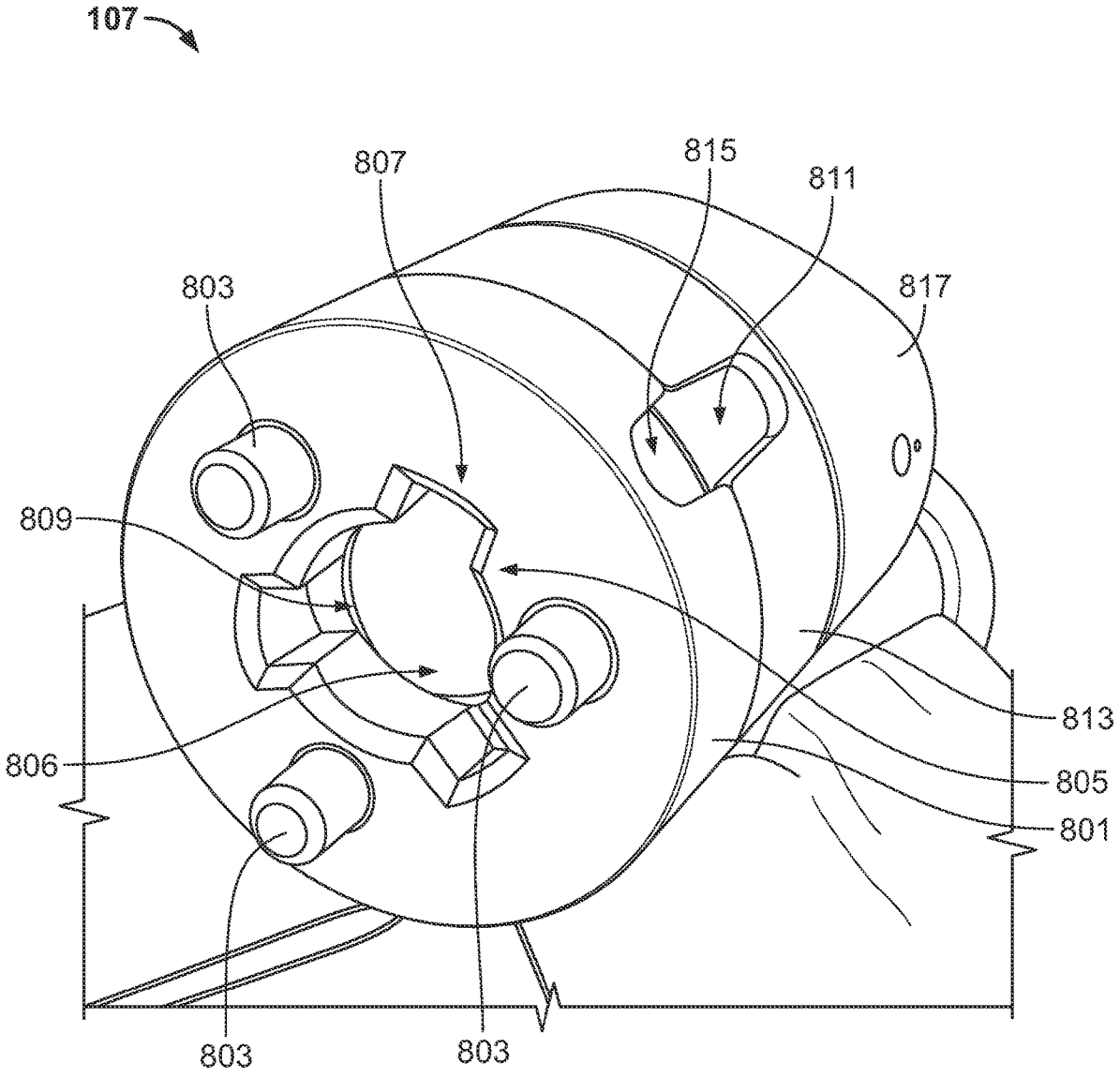
FIG. 8B is a perspective view of the hub in the locked position.
Figure 8C:
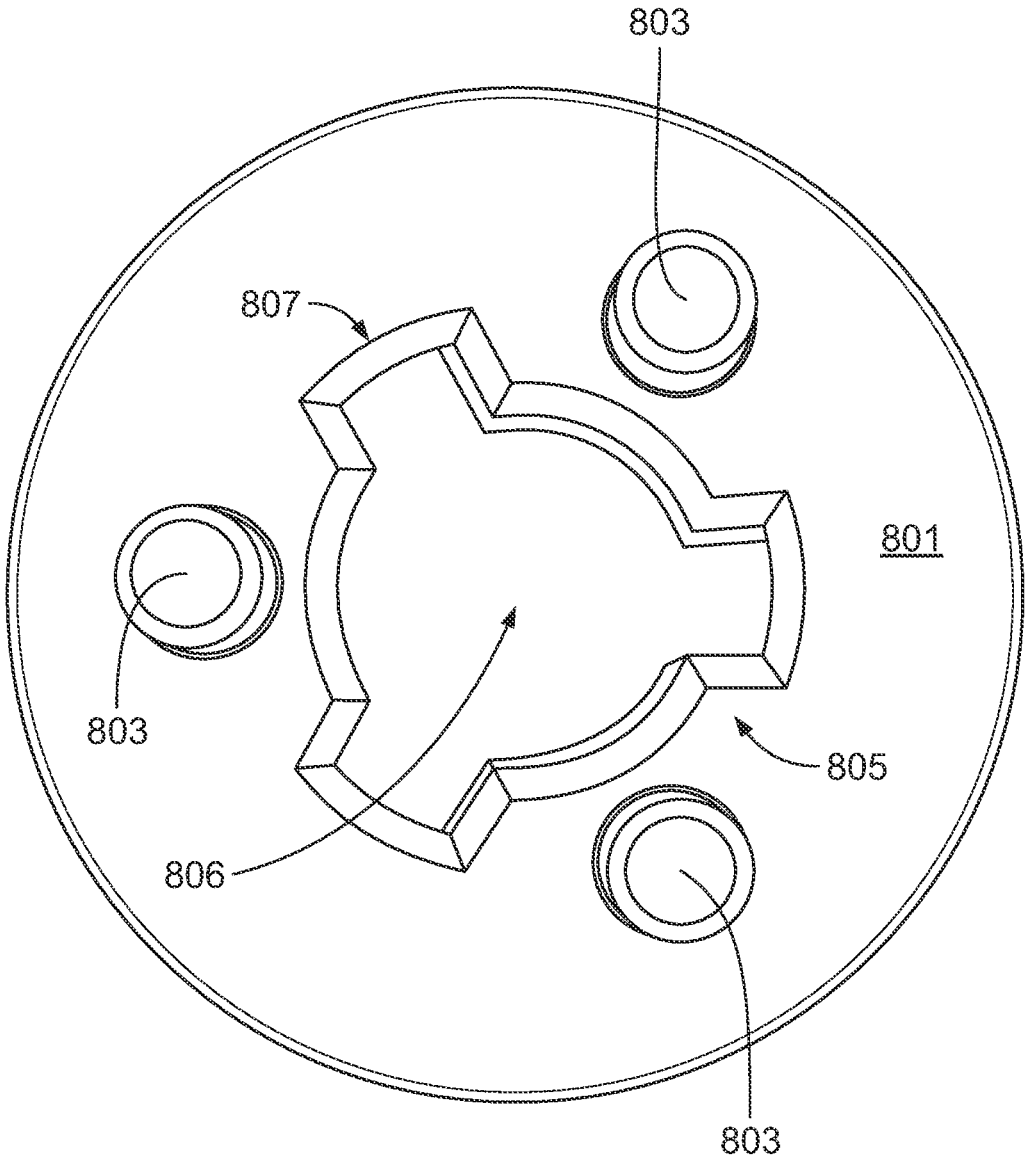
FIG. 8C is a bottom view of the hub in a unlocked position.
Figure 8D:
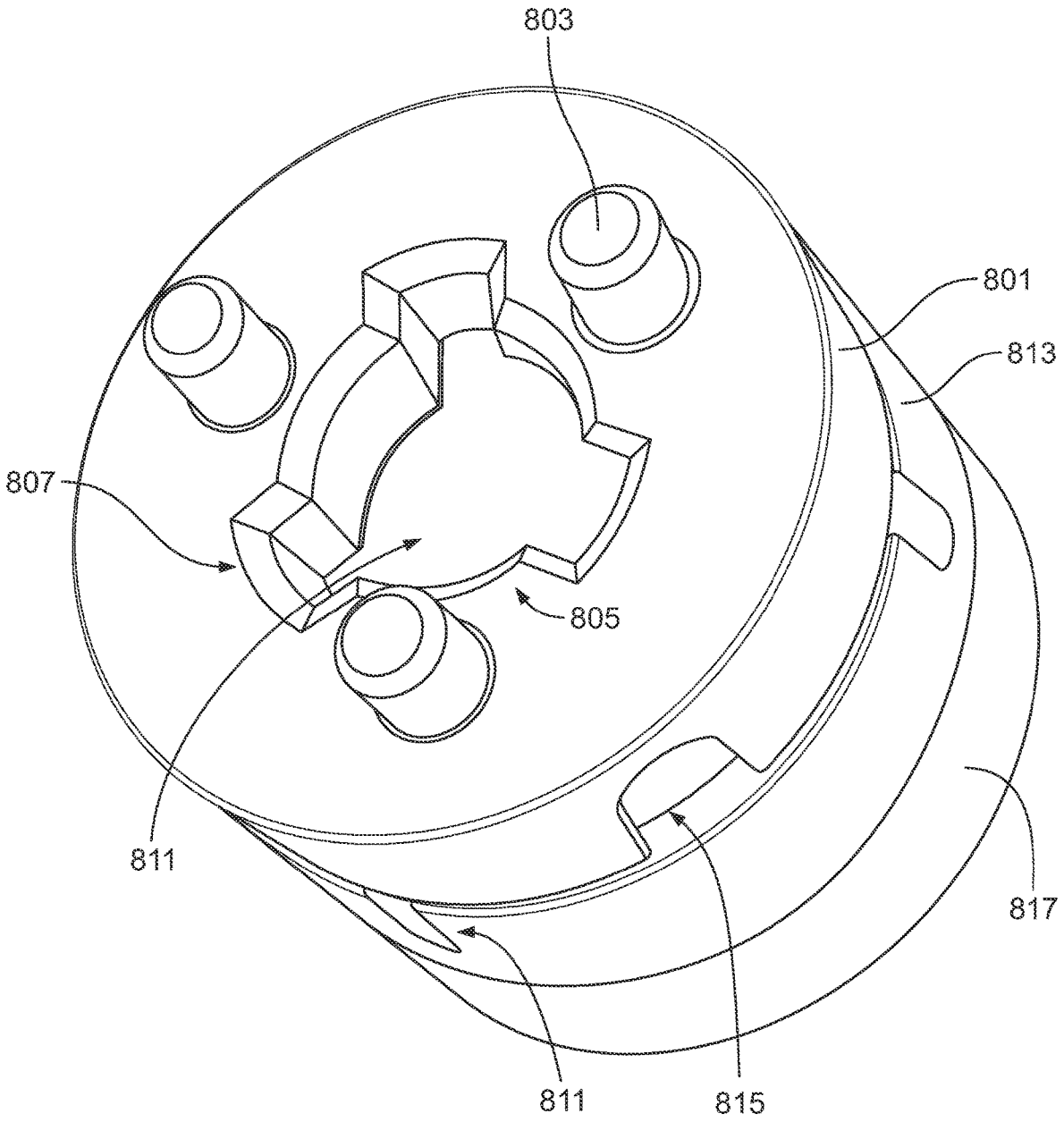
FIG. 8D is a perspective view of the hub in the unlocked position.

Shown in FIG. 8A and FIG. 8B is a bottom view and a perspective view, respectively, of an example hub 107 that may be coupled to the versatile sling 101 to releasably attach different accessories. In this example, the hub 107 has a proximal end portion 817, a middle portion 813, and a distal end portion 801. The hub's distal end portion 801 defines an opening or recess 805, which can be substantially centrally disposed with respect to a centerline (or longitudinal axis) of the hub 107, as shown in FIG. 8A, and which opening 805 is in communication with a cavity 806 defined by the distal end portion 801 of the hub 107. The cavity 806 is configured to receive, via the opening 805, a protrusion of an accessory to be attached to the hub. A perimeter of the opening 805 defines a plurality of cutouts 807. Each cutout 807 is configured to receive a tooth extended from an outer perimeter of the protrusion of the accessory configured to be received within the opening 805 and cavity 806 (see cutouts from center recess, 807). The hub 107 can have a first or locked position (see, e.g., FIGS. 8A-8B) and a second or unlocked position (see, e.g., FIGS. 8C-8D). In the locked position, the hub 107 is configured to prevent the removal of the protrusion from the opening 805. For example, as shown in FIG. 8A, the hub 107 includes a locking mechanism 809 that is in a position between the teeth of the accessory protrusion (e.g., a distal shoulder or edge portion thereof) and the cutout of the distal end portion 801 of the hub 107, such that the locking mechanism 809 prevents the teeth from being withdrawn via the cutouts 807 thereby locking the accessory to the hub 107 and preventing the accessory's protrusion from being withdrawn from the distal end portion 801 of the hub 107. In some embodiments, the locking mechanism is located in or otherwise coupled to the middle portion of the hub. In some embodiments, the locking mechanism 809 is a rotatable element that encircles the inserted protrusion below (or distal to) the plurality of teeth, thereby retaining the accessory, cap, or other object. For example, the middle portion 813 of the hub 107 can be rotatable with respect to the distal end portion 801 of the hub to lock the hub (e.g., to move the hub to the locked position).

When the hub 107 is in the unlocked position, an accessory, cap, or other object having a protrusion with a plurality of teeth that corresponds to the opening 805 and cutouts 807 may be inserted into the hub 107. Following insertion, the middle portion 813 of the hub may be rotated to engage the locking mechanism 809, e.g., with a shoulder of the teeth of the accessory's protrusion as described herein.

In some embodiments, the hub 107 defines notches 811 and 815 on the middle portion 813 and distal end portion 801, respectively, of the hub. The notches 811 and 815 can be configured to align with each other as a tactile and/or visual indication that the hub is in the locked position. The notches 811 and 815 can also be recessed with respect to an outer surface of the hub to facilitate the user's grip on the hub when rotating the middle portion 813 of the hub with respect to the distal end portion 801 of the hub. In another embodiment, the hub comprises protrusions on the outer surface of the hub as indicators of a locked or unlocked position, and to facilitate the user's grip on the hub when rotating the middle portion of the hub.

The distal end portion 801 of the hub 107 can include one or more elongated protrusions 803 (e.g., three elongated protrusions as shown in FIG. 8A, configured to be at least partially received in corresponding or complementary recesses of an accessory.

Figure 8E:
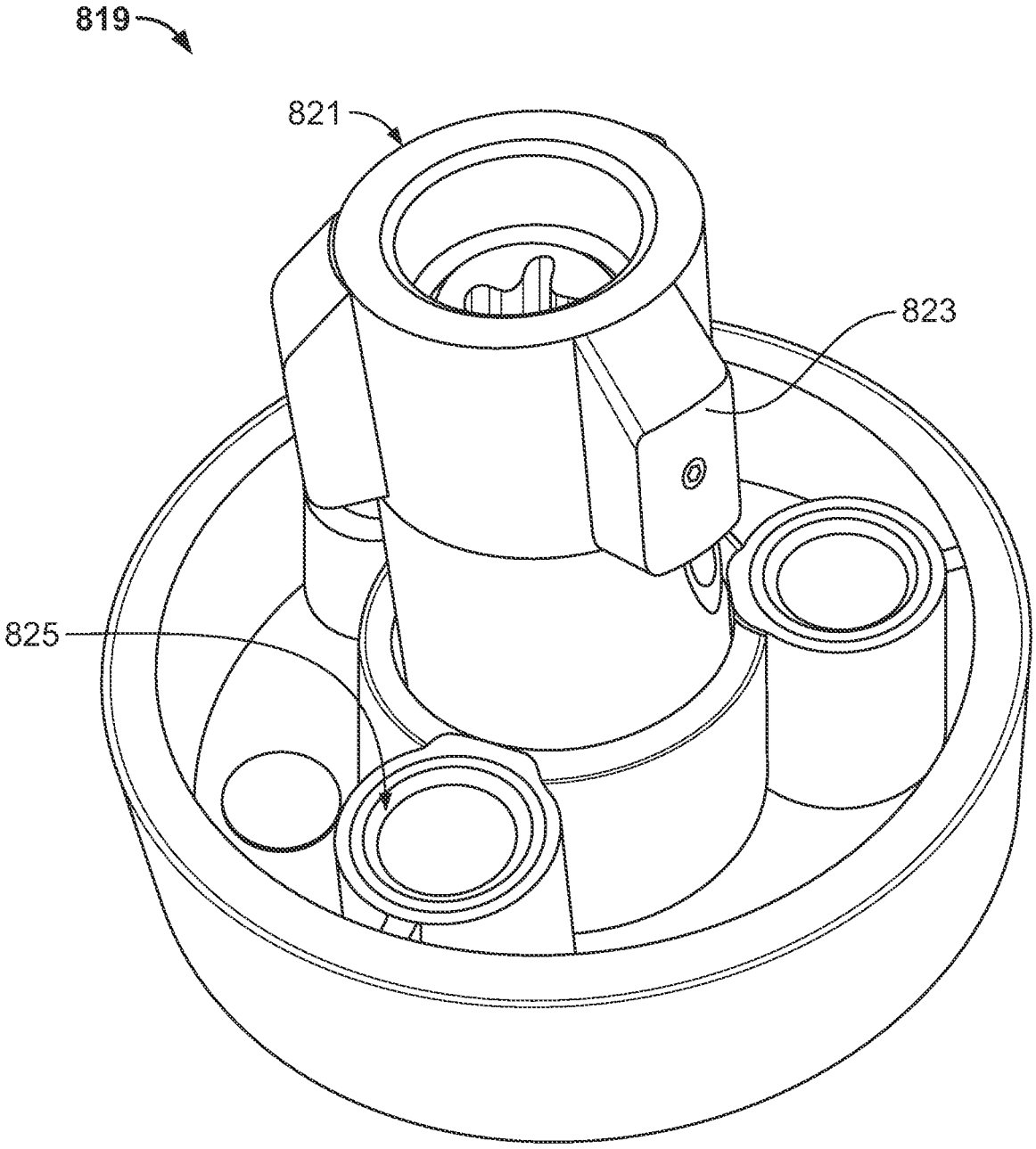
FIG. 8E is a perspective view of a hub cap.
Figure 8F:
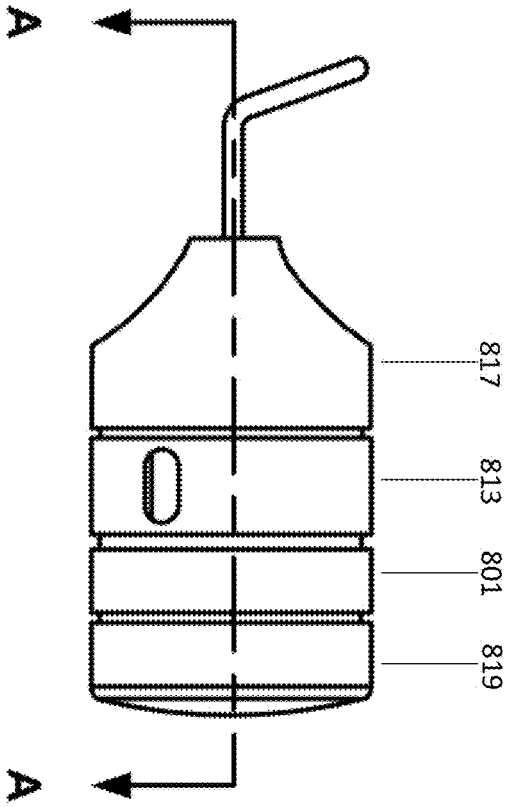
FIG. 8F is a side view of the hub with the hub cap coupled to the hub.
Figure 8G:
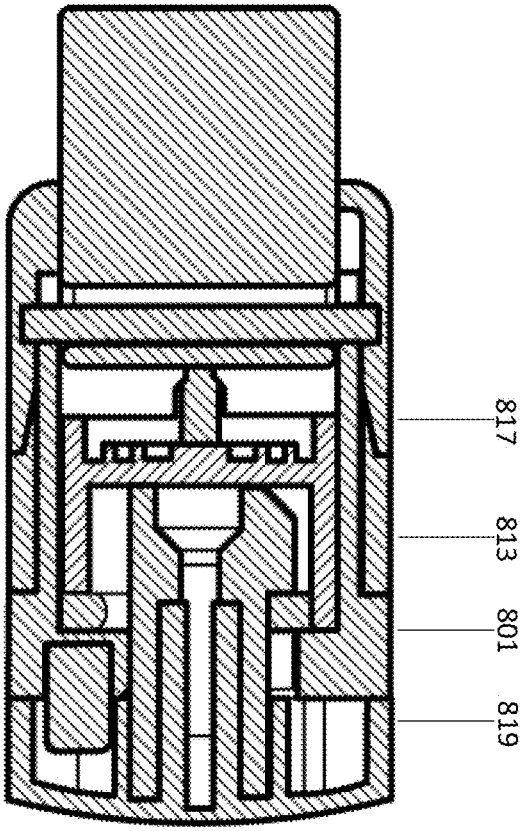
FIG. 8G is a cross-sectional view of the hub shown in FIG. 8F taken along line A-A.
Figure 8H:
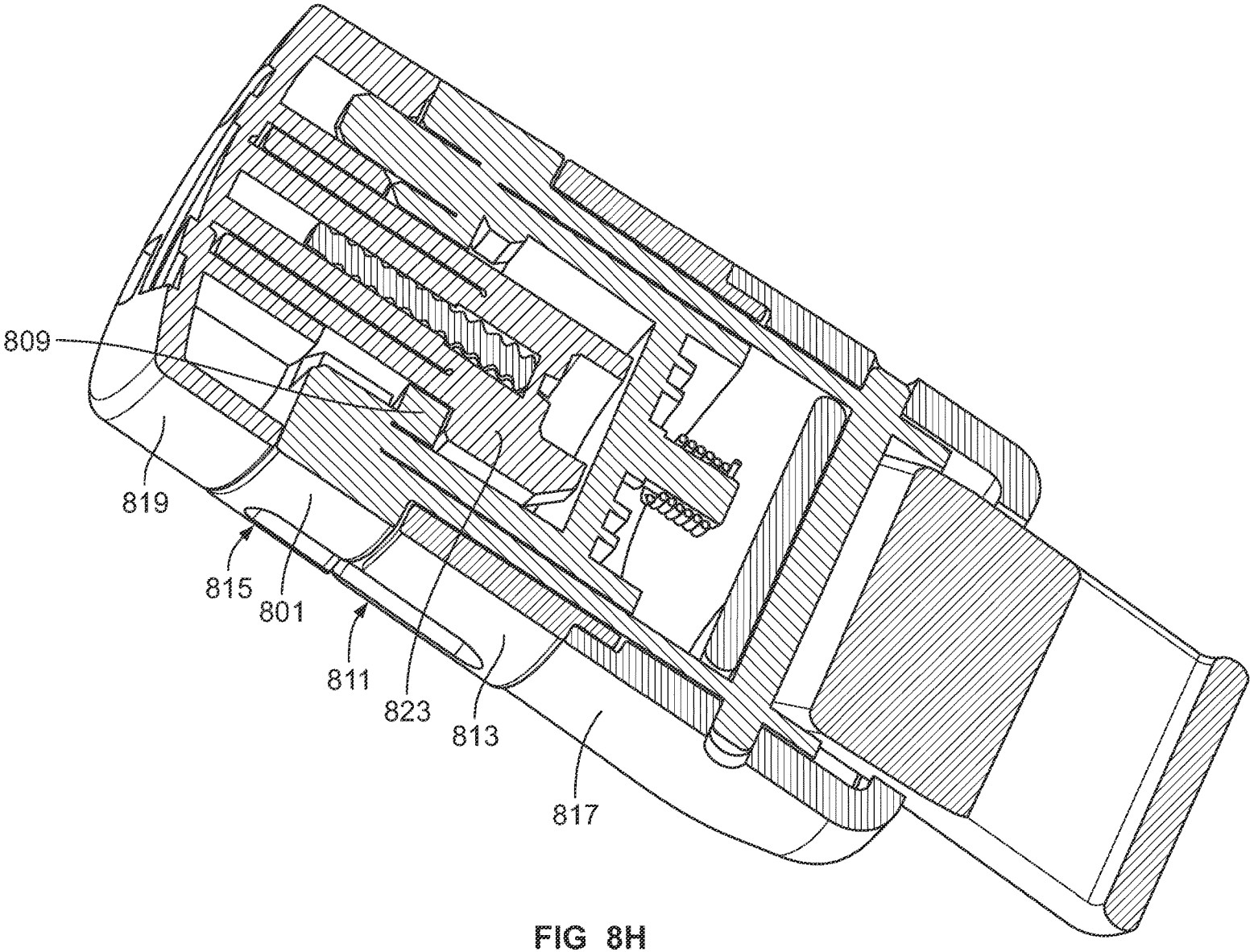
FIG. 8H is a cross-sectional perspective view of the hub taken along line A-A as shown in 8F.
Figure 8I:
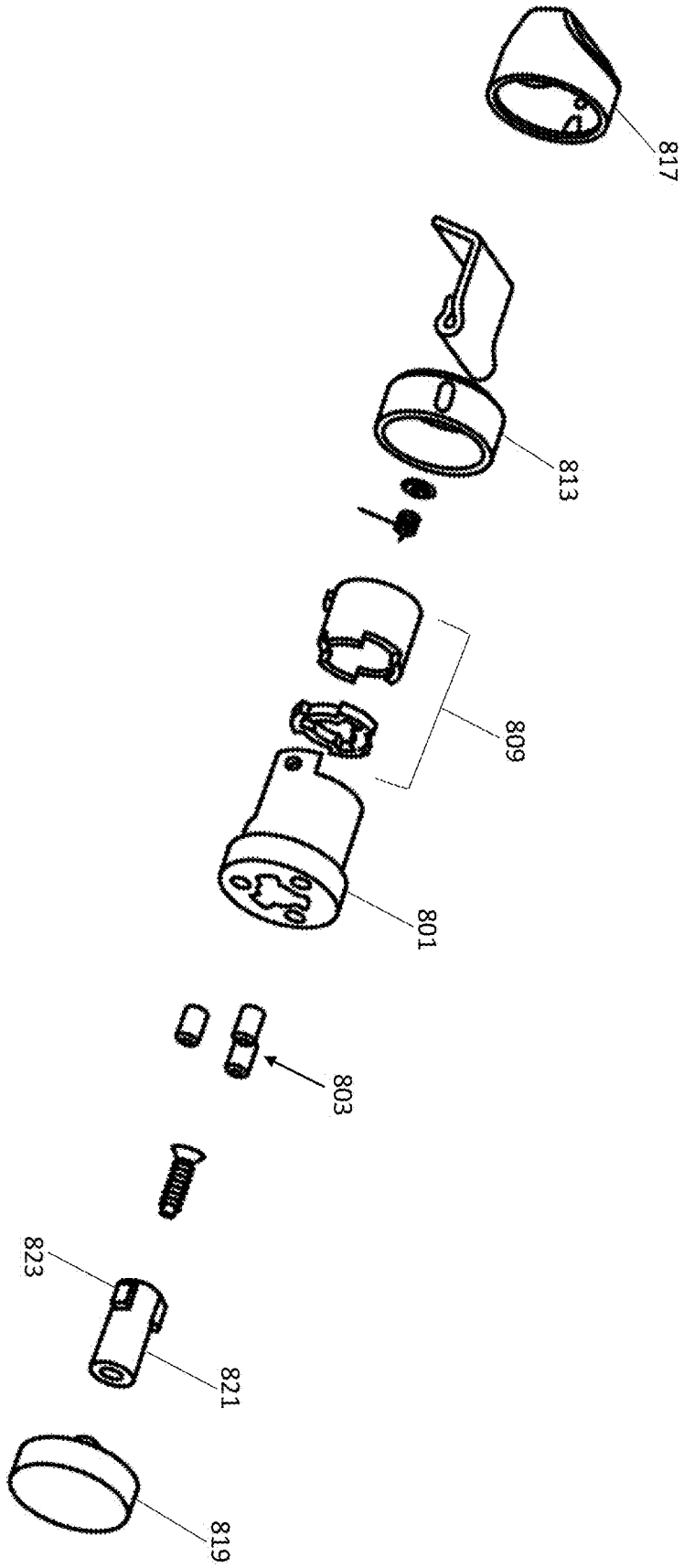
FIG. 8I is an exploded view of the hub of FIG. 8F.

Shown in FIG. 8E is an example of a cap 819 with a center protrusion 821 having teeth 823 (e.g., three teeth) extending from the outer perimeter of the protrusion 821 of the cap 819. The cap 819 further comprises a plurality of recesses 825 around the center protrusion 821, configured to at least partially receive the plurality of protrusions 803 on the distal end 801 of the hub 107. The cap 819 is removably coupled to the hub in a manner similar to that described above for coupling an accessory to the hub. The cap 819 can be used, for example, to cover a face of the distal end portion 801 of the hub 107 when no accessory is coupled to the hub. In this manner, the cap is configured to prevent dirt or other debris from entering the cavity 806 via the opening 805. Accessory items having a similar configuration as that shown by the cap in 819 may be attached to this example hub.

As will be understood by one skilled in the art, the proximal end portion 817 of the hub may be configured to be attached to any first object. The center opening 805 and cutouts 807 to accommodate a matching protrusion and teeth on any second object may be of any number, shape, or size. For example, although the distal end portion 801 of the hub 107 is shown as defining three cutouts configured to receive up to three teeth of a protrusion of a corresponding accessory or cap, in other embodiments, the distal end portion of a hub can include one, two, four, or more such cutouts and the accessory or cap can include any suitable number of teeth, though in some embodiments, the number of teeth of the accessory can differ from the number of cutouts of the distal end portion of the hub. Although the hub 107 is shown and described as including three protrusions extended from the face of the distal end portion 801 of the hub, in some embodiments, the distal end portion 801 of the hub 107 does not comprise any such protrusions 803. In another example, in some embodiments, the distal end portion 801 of the hub 107 comprises one protrusion 803. In some embodiments, the distal end portion 801 of the hub 107 comprises two protrusions 803. In some embodiments, the distal end portion 801 of the hub 107 comprises four, five, or more such protrusions 803.

Figure 16A:
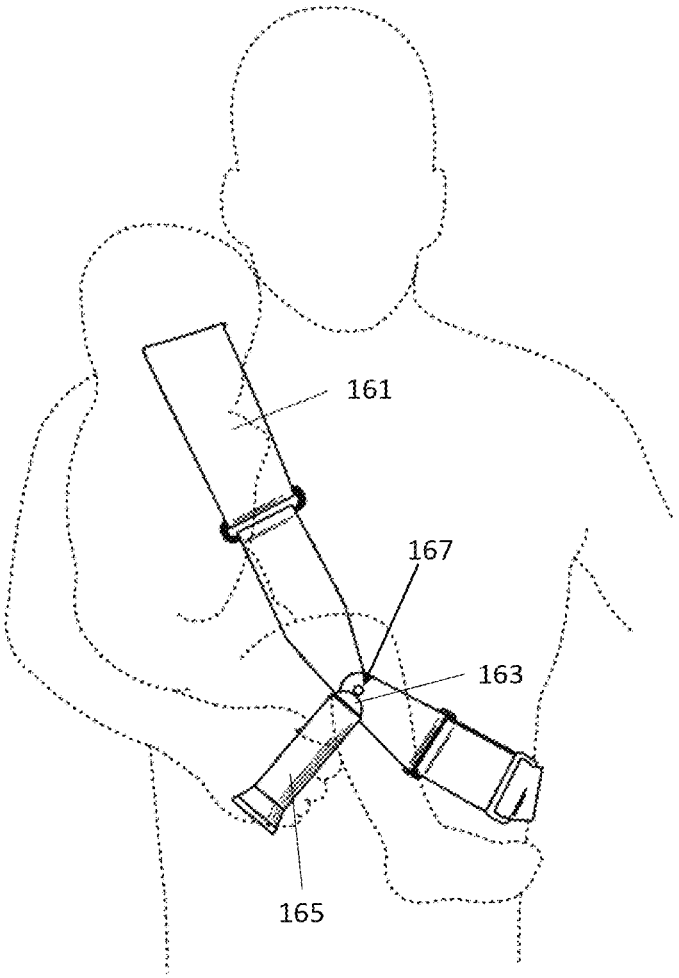
FIG. 16A is a front view of a person wearing a versatile sling, according to an embodiment, with an accessory according to an embodiment coupled to the sling, and the person is holding a child and distributing some of the child's weight to their shoulder and torso region by grasping the accessory coupled to the slip with the same hand as the arm in which the child sits.
Figure 16B:
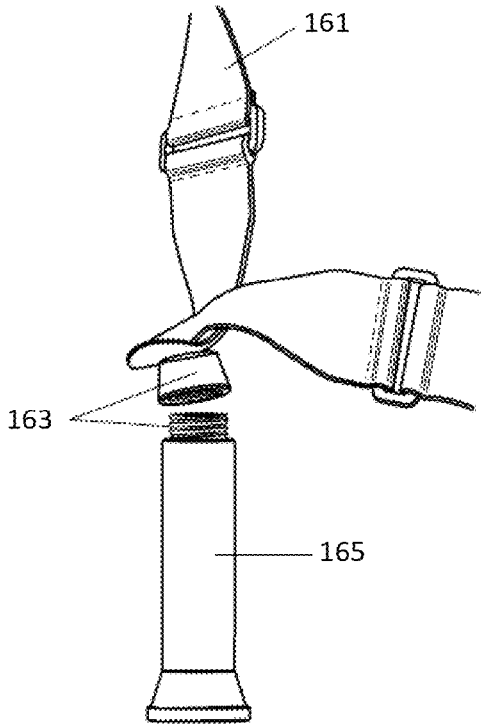
FIG. 16B is a perspective view of a portion of a versatile sling, according to an embodiment, with a hub and coupling mechanism for the ends of the strap and the hub.

In some embodiments, the hub is a screw cap 163 (see, e.g., FIG. 16B). In some embodiments, the screw cap has a locking mechanism, for example a child-resistant locking closure mechanism (push down and turn). In some embodiments, a carabiner may function as a hub to releasably attach accessories to the ring 109. In addition to the hub 107, screw cap 163, and carabiner examples provided herein, a person skilled in the art will understand that there are a number of means for releasably attaching an accessory, such as a handle or a leash, to the versatile sling.

In some embodiments, the versatile sling further comprises snaps, ties, clips and knobs which fits into a groove or slot, or equivalent fasteners.

Depending on the mode and location of the accessory attachment, for example, coupled to a hub suspended from the sling and/or one or more of the attachment systems described above, the accessory may be in a fixed position in a particular orientation, or it may rotate or tilt.

In some embodiments, the accessory is a handle or a leash. In some embodiments, the handle includes a rod, loop, hook, clip, carabiner, or combinations thereof. Handle accessories may further comprise a retractable cord or leash, so that the cord or leash may be pulled out to a desired length and then retracted back to the handle.

Figure 9A:
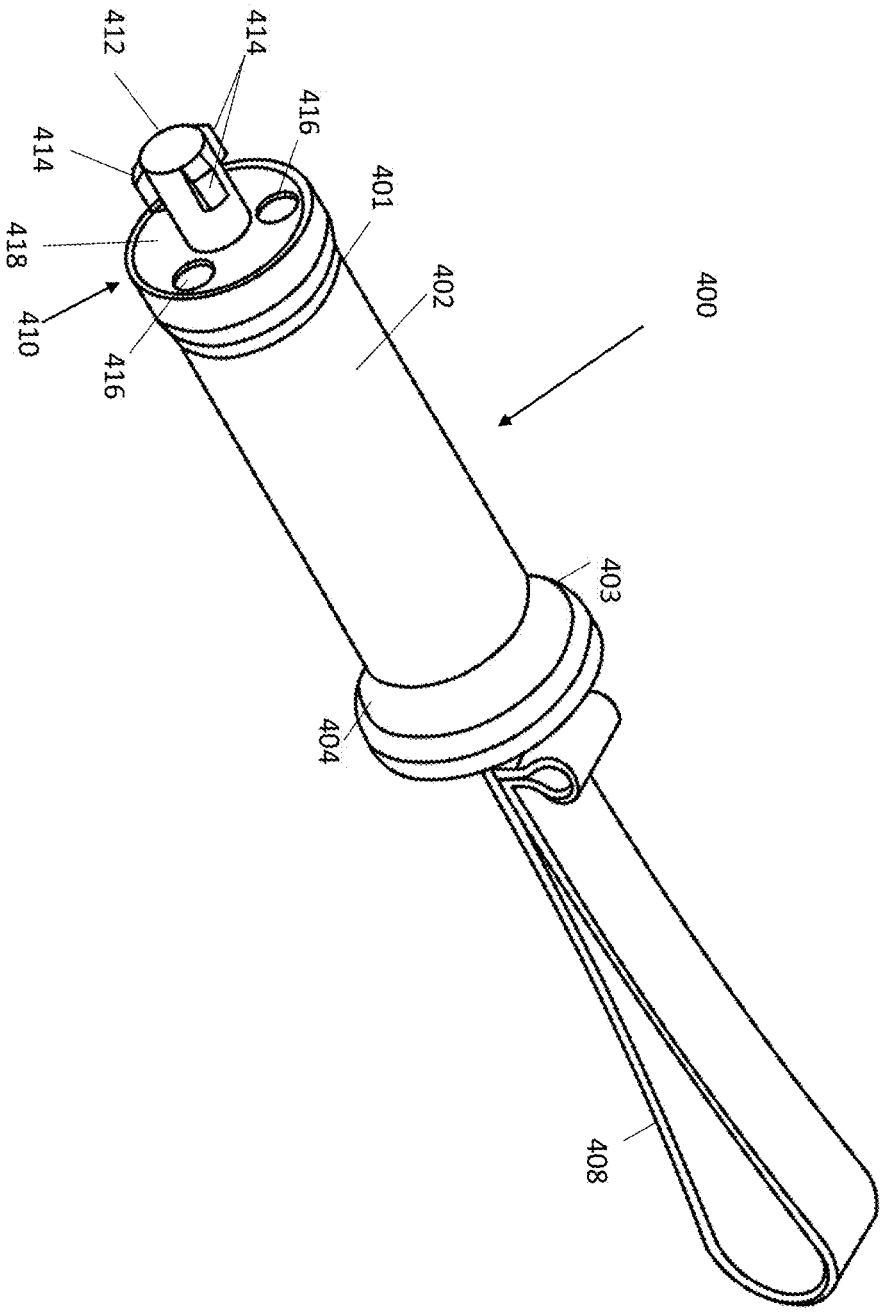
FIG. 9A is a perspective view of a handle with loop accessory, according to an embodiment.
Figure 9B:
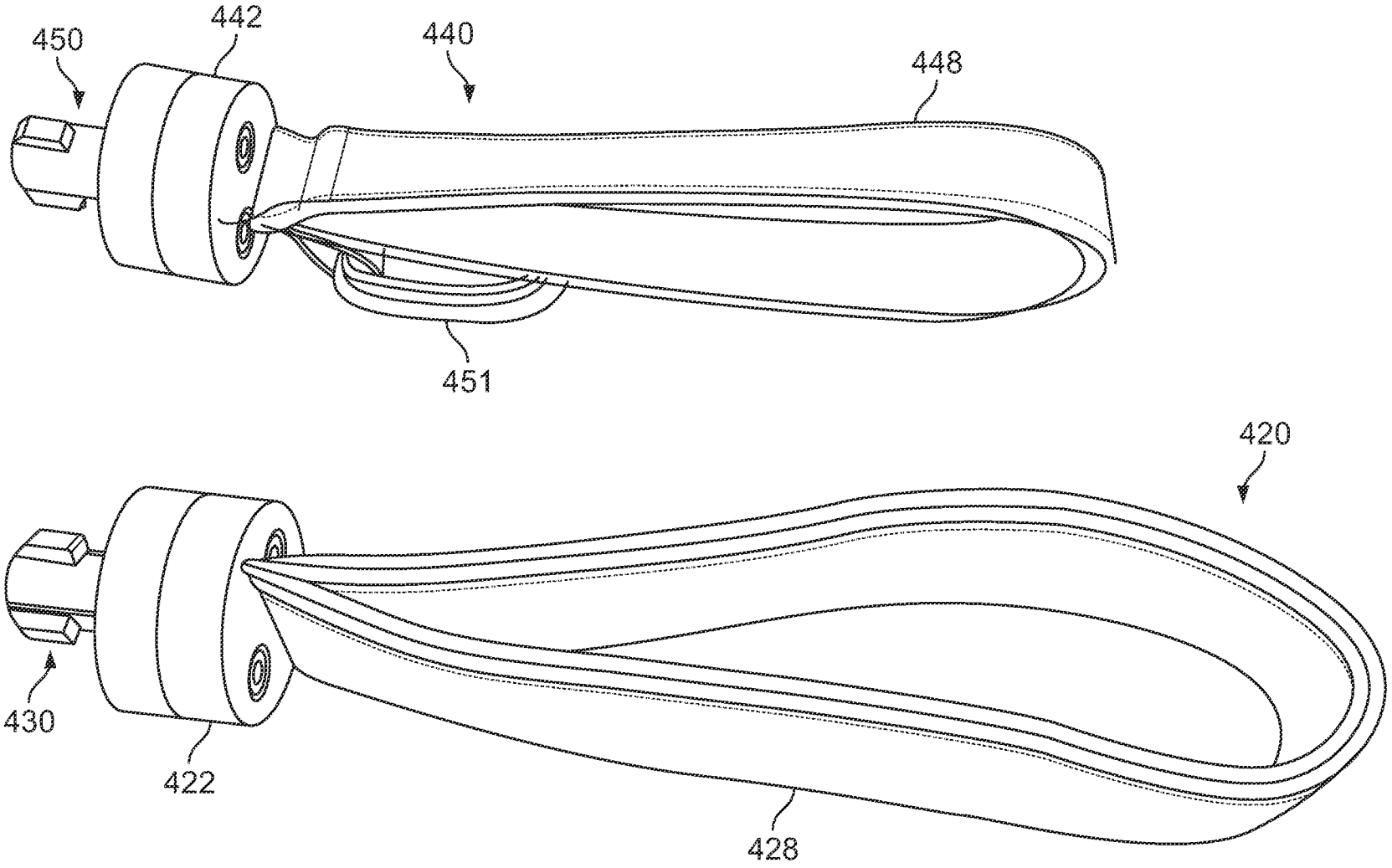
FIG. 9B is a perspective view of two handle with loop accessories, according to embodiments.

As will be discussed in more detail, the accessories are interchangeable with respect to the hub, and thus depending on the use or need and the user's preference, a variety of accessories may be utilized with the versatile sling. Shown in FIGS. 9A-11B are example accessories that may be releasably attached to a hub on a versatile sling. In FIG. 9A, a handle accessory 400 is shown. The handle accessory 400 can include a rod portion 402 with a proximal end portion 401 and a distal end portion 403, which distal end portion 403 can include a shoulder or flange 404. A loop portion 408 is coupled to the distal end portion 403 of the rod portion 402. The loop portion 408 and/or the rod portion 402 can be used as a handle, such that it is configured to be gripped by a user. A connector assembly 410, shown in FIG. 9A as coupled to the proximal end portion 401 of the rod portion 402, is configured to be reversibly coupled to a hub according to an embodiment (e.g., any hub described herein, such as hub ###). Features of the connector assembly 410 (e.g., the protrusion 821, teeth 823 and/or recesses 825) can be similar in many respects, or identical to, corresponding features of the cap 819, described herein. The connector assembly 410 of the handle accessory 400 can include a protrusion 412 (e.g., an elongate, and optionally substantially cylindrical protrusion) that extends proximally from a face 418 of the connector assembly 410. The protrusion 412 can include one or more teeth 414 extended from a side portion of (or otherwise extended laterally with respect to) the protrusion 412. The teeth can include an angled proximal edge portion and/or a substantially squared distal shoulder. The substantially squared distal shoulder helps to retain the connector assembly 410 to the hub, as described in more detail herein. As shown in FIG. 9A, the connector assembly 410 can include three teeth 414, which can be spaced apart (e.g., substantially equidistantly) about a perimeter of the protrusion 412. In some embodiments, however, a connector assembly can include one, two, four or more such teeth, spaced in any suitable manner about the perimeter of the protrusion, or no such teeth. The connector assembly 410 can include one or more recesses 416, such as three as shown in FIG. 9A or a complementary number of recesses to correspond to a number of protrusion of a hub, configured to receive at least a portion of a hub, as described herein. Although the handle accessory 400 is shown in FIG. 9A with an elongate rod portion 402 and a loop portion 408 having a relative length with respect to the rod portion 402, in other embodiments, the rod portion and/or the loop portion can be differently configured. For example, as shown in FIG. 9B, handle accessories 420, 440 according to embodiments can include loop portions 428, 448, respectively of different lengths, rod portions 422, 442 of different lengths (e.g., shorter than rod portion 402) and/or of lengths shorter than the loop portions. Each of the handle accessories 420, 440 can include a connector assembly 430, 450, respectively, configured to be coupled to a hub (e.g., any hub described herein, such as hub ###). In some embodiments, the handle accessory 440 can also or alternatively include a connector 451, such as carabiner. The rod portion or loop portion of any of the handle accessories described herein can also or alternatively include a means for reversibly attaching the handle to an item, for example using a carabiner or similar type clip or fastener (see, e.g., connector 451 of handle accessory 440 in FIG. 9C).

Figure 10:
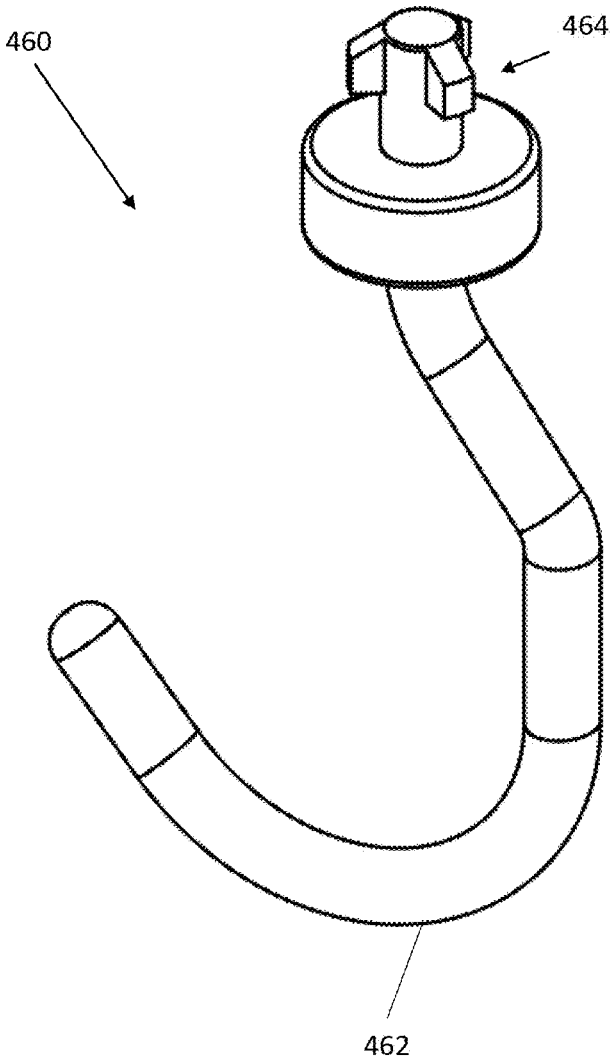
FIG. 10 is a perspective view of a hook accessory, according to an embodiment.

In FIG. 10, a hook accessory 460 is shown. The hook accessory 460 can include a hood portion 462 and a connector assembly 464. The connector assembly 464 is configured to be reversibly coupled to a hub, as described herein. The connector assembly 464 can be similar in many respects, or identical to, any connector assembly 464 described herein (e.g., connector assembly 410), and thus is not described in detail here. Although the connector assembly 464 as shown in FIG. 10 does not include recesses disposed on a face of the connector assembly 464, e.g., disposed about the protrusion, in other embodiments, the connector assembly 464 can include one or more of such recesses configured to receive a portion of a protrusion of a hub.

Figure 11A:
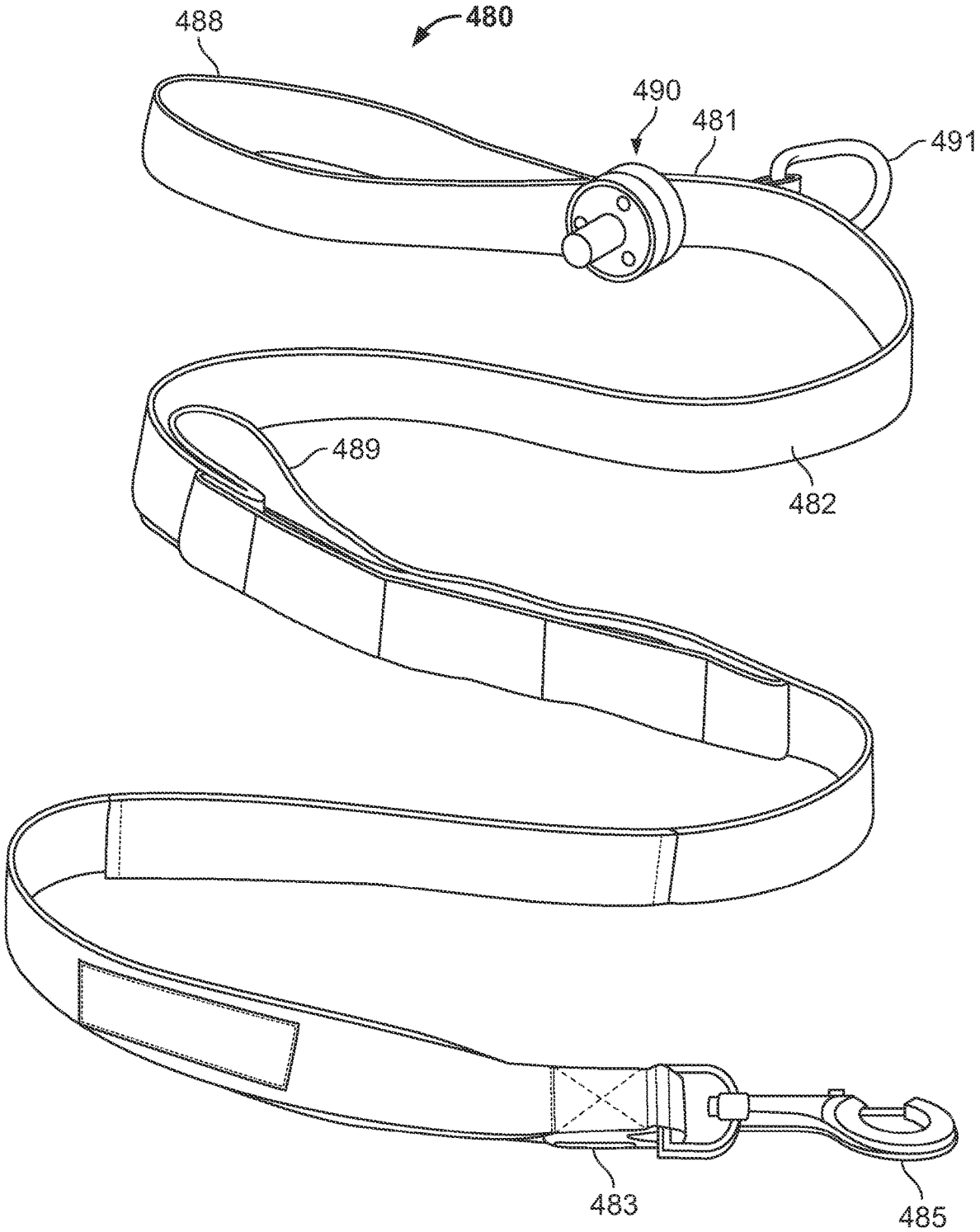
FIG. 11A is a front perspective view of a leash accessory, according to an embodiment.
Figure 11B:
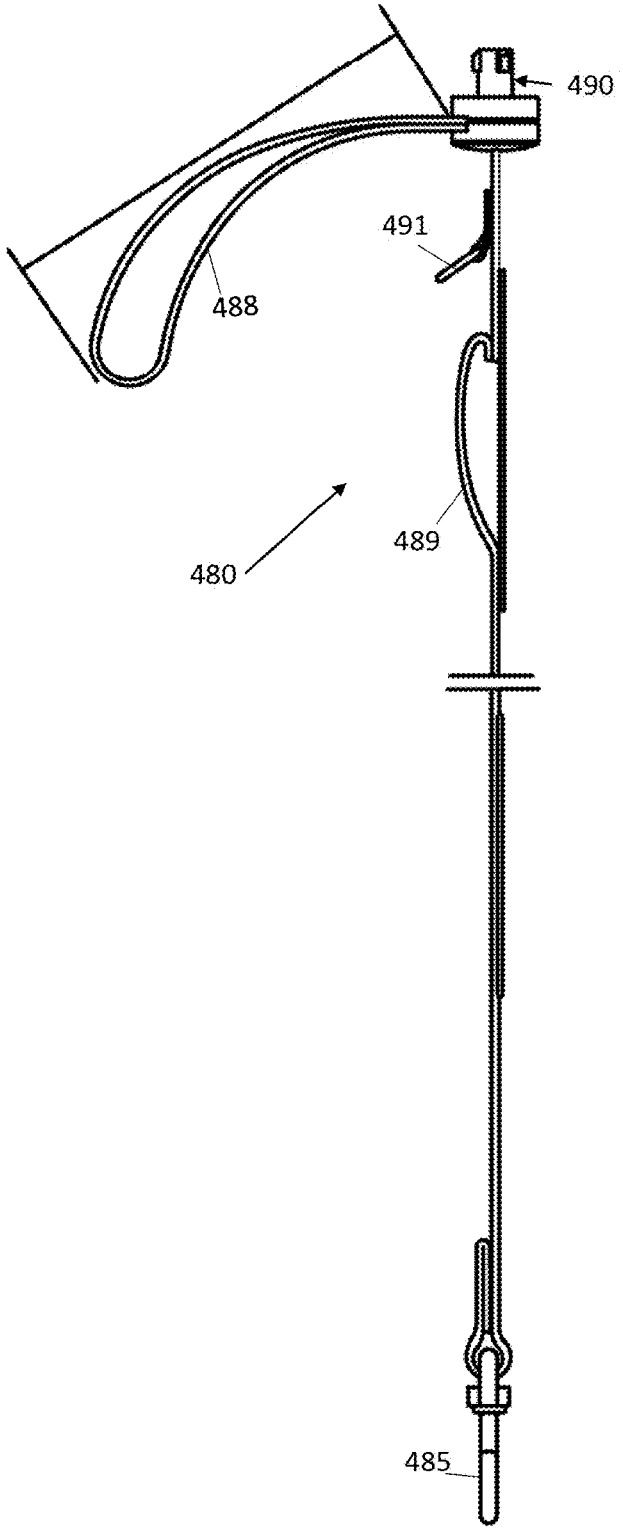
FIG. 11B is a side view of the leash shown in FIG. 11A.
Figure 12A:
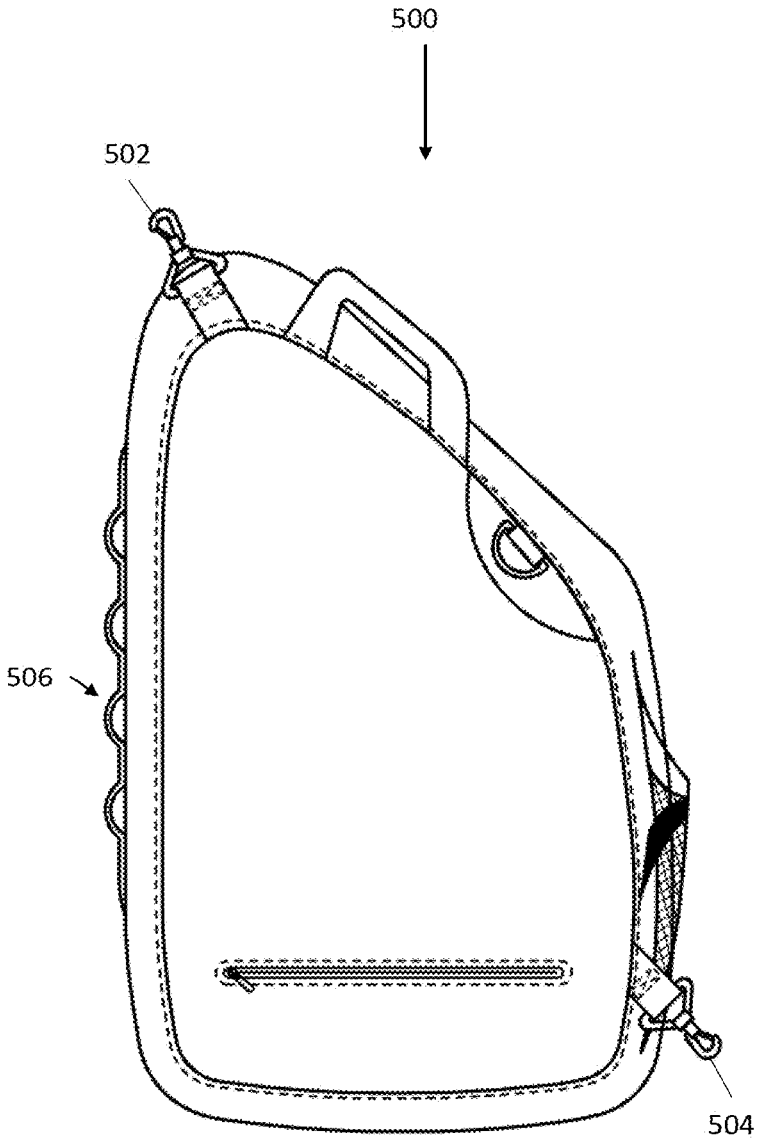
FIG. 12A is a rear view of a backpack accessory, according to an embodiment.
Figure 12B:
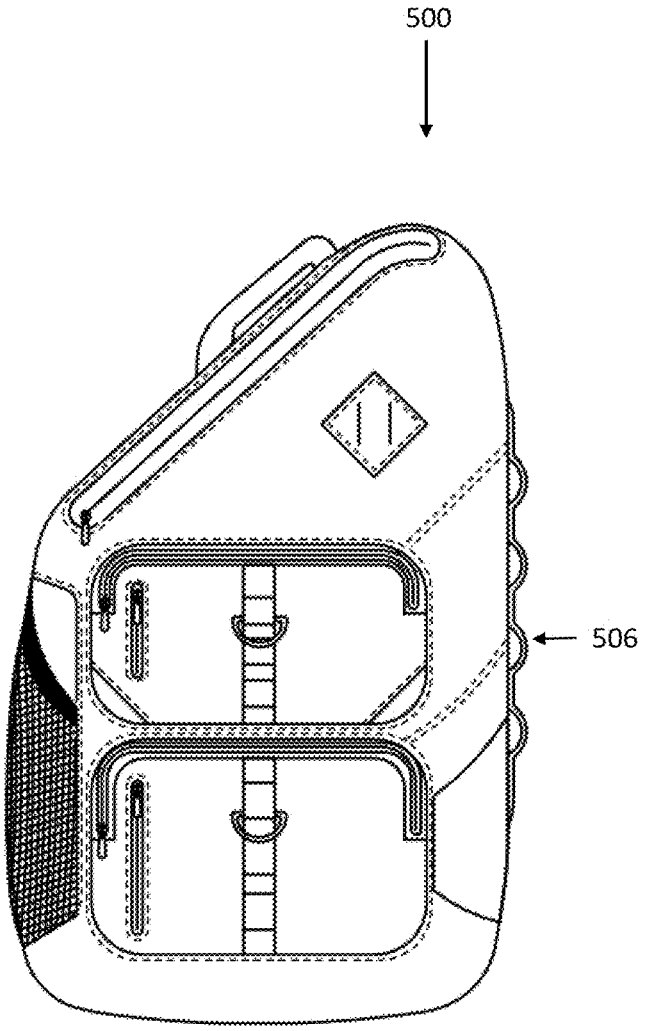
FIG. 12B is a front view of the backpack accessory of FIG. 12A.

In FIGS. 11A and 11B, a leash accessory 480 is shown, which can be, e.g., a dog leash. The leash accessory 480 includes a flexible elongate member 482 with a proximal end portion 481 and a distal end portion 483. A connector assembly 490 is coupled to the proximal end portion 481 of the flexible elongate member 482. The connector assembly 490 is configured to be reversible coupled to a hub, as described herein, and can be similar or identical to any connector assembly described herein (e.g., connector assembly 410, 430, 450, 464), and thus is not described in detail herein. A loop portion 488 is coupled to the proximal end portion 481 of the flexible elongate member 482. The loop portion 488 can be, for example, a handle for the leash accessory. The flexible elongate member 482 can include a second loop portion 489 disposed between the proximal and distal end portions 481, 483 of the flexible elongate member, which can be, for example, a second handle of the leash accessory. A fastener 485 (e.g., a bolt snap) can be coupled to the distal end portion 483 of the flexible elongate member 482 of the leash accessory 480, which fastener can be reversible coupled to, for example, an animal collar. The leash accessory 480 can optionally include a connector ring 491 configured to facilitate coupling to another item.

In some embodiments, the handle accessories are wrapped in a compressible material, or rubber, such as neoprene, to enhance the grip and comfort of the wearer. In some embodiments, the handle accessory is ergonomically designed.

Shown in FIGS. 12A-14B are example accessories configured to be releasably coupled to the versatile sling using an attachment system, such as attachment system 201 described herein. For example, in some embodiments, the accessory can include a backpack 500 (see, e.g., FIGS. 12A and 12B), which can be coupled to the sling via an attachment system described herein. The backpack 500 can include snap hooks 502, 504 coupled to the backpack in spaced apart locations, such as a first snap hook 502 at an upper end portion of the backpack and a second snap hook 504 at a lower end portion of the backpack. The snap hooks 502, 504 are configured to be reversibly attached to loops and/or rings of the attachment system. The backpack 500 can include an attachment system 506 coupled to an outer surface thereof, which attachment system can include an elongate member coupled to the surface of the backpack 500 to form a series of loops, similar to that of the attachment system 201.

Figure 13A:
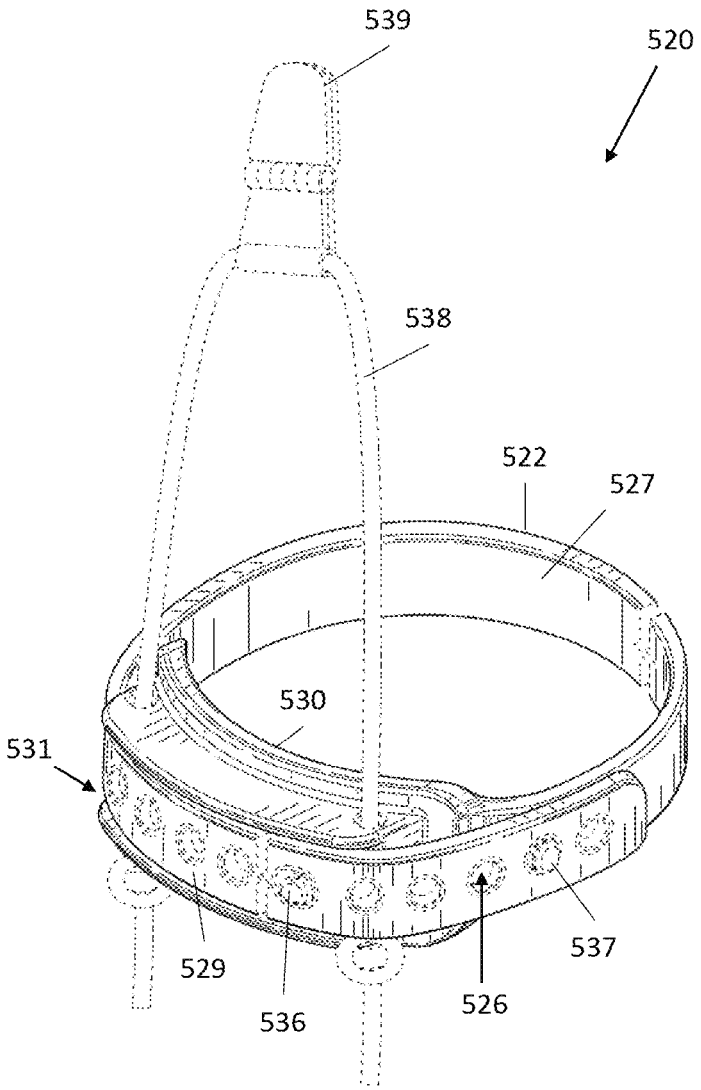
FIG. 13A is a perspective view of a container (e.g., beverage) holder accessory, according to an embodiment, in a closed configuration.
Figure 13B:
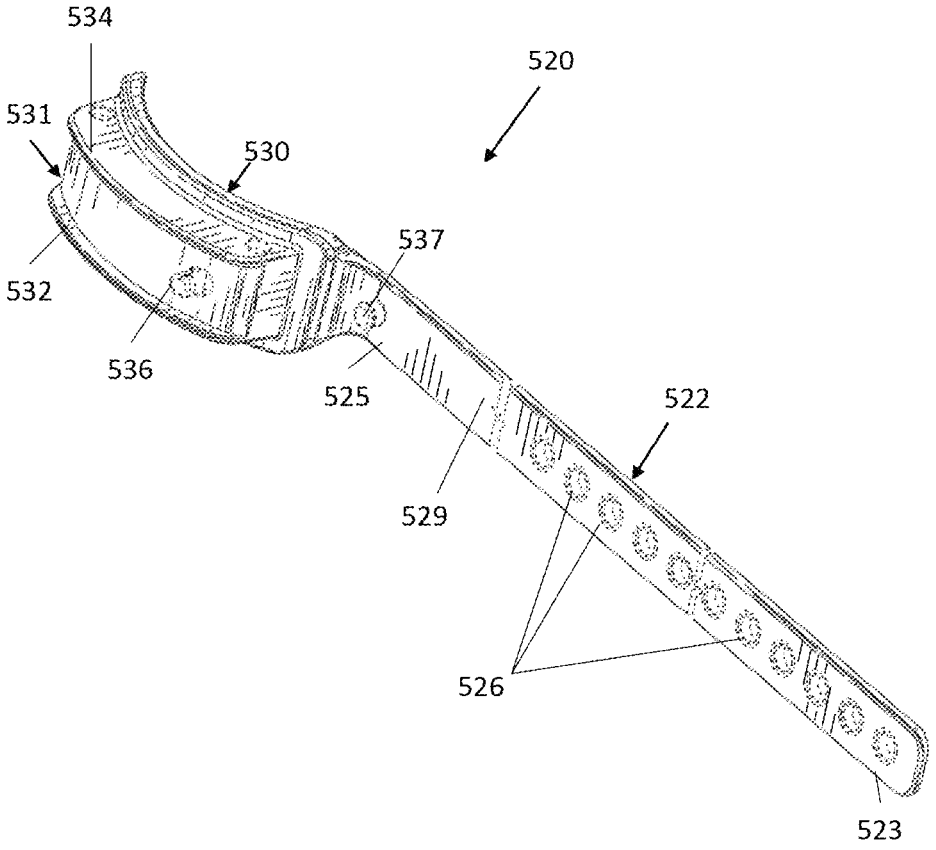
FIG. 13B is a perspective view of the container (e.g., beverage) holder accessory of FIG. 13A in an open configuration.

In another example, the accessory can include a container holder 520 (see, e.g., FIG. 13A and FIG. 13B) which can be coupled to a sling described herein, such as via an alligator clip 539 (or other suitable connector, like a carabiner, snap hook, hook and loop fastener, or the like) coupled to an attachment system or other portion of the sling ad which clip 539 can be coupled to the container holder via a cord or strap 538 configured to permit the container holder 520, and thus also a container held or secured therein, to hang freely from the sling. In some embodiments, the cord 538 can be of sufficient length (or have an adjustable length) to permit the cord to be worn around the neck of the user, e.g., independently of the sling. The container holder 520 has a strap portion 522 and a buckle portion 530. The container holder 520 has an open or unassembled configuration, as shown in FIG. 13B, and a closed or assembled configuration, as shown in FIG. 13A. In the closed configuration, the strap portion 522 can be disposed about the container to be held such that the strap is looped about the buckle portion 530, as shown in FIG. 13A. In some embodiments, the strap portion 522 is disposed about the buckle portion 530 such that an inner surface of the strap portion is in contact with an outer surface of the buckle portion. In some embodiments, a protrusion 536 extended from an outer surface of the buckle portion 530 is extended through an aperture 526 defined by the strap portion 522. The protrusion 536 can have a hook portion on a free end thereof, to facilitate retention of the strap portion 522 via the aperture 526. The strap portion 522 can include any suitable number of apertures such as one to about twenty apertures defined by the strap and extending from a first or outer surface of the strap to a second or inner surface of the strap, such as ten apertures as shown. In some embodiments, the protrusion 536 is extended through one aperture 526 of the strap portion 522 and another protrusion 537 can be extended through another aperture 526 of the strap portion, to more securely retain the container holder in the closed configuration. The protrusion 537 is shown extending from a portion of the strap portion 522 proximate the buckle portion 530. In other embodiments, however, the protrusion 537 can be extended from the buckle portion 530. In other embodiments, the container holder can include only one of the protrusions 536, 537 shown in FIG. 13B. The outer surface of the buckle portion 530 can include a channel 531 defined between raised edge portions 532, 534 disposed on either side of the channel. At least a portion of the strap portion 522 is configured to be received in the channel 531. The channel 531 can have a depth that enables the strap portion 522 to be substantially flush with or lower than the raised edge portions 532, 534 of the buckle portion 530. In this manner, the channel 531 helps to prevent or otherwise minimize lateral (with respect to a longitudinal axis of the strap portion 522) movement of the strap portion with respect to the buckle portion 530 when the container holder is in the closed configuration. In the closed or assembled configuration, the container holder 520 is configured to be reversibly secured about a container, such as a beverage container like a water bottle, sippy cup, or reusable drink container, and the like. The buckle portion 530 can define a radius of curvature that facilitates the inner surface of the container holder 520 contacting the container secured therein. For example, an inner surface of the buckle portion 530 can define a concave curvature, when viewed from a top or bottom view. The strap portion 522 and/or the buckle portion 530 can be flexible. In some embodiments, the strap portion 522 is more flexible than the buckle portion 530.

Although the container holder 520 is shown and described as including an exposed channel 531 with raised edge portions 532, 534 configured to help retain the strap portion 522 to the buckle portion 530, in other embodiments, the container holder can be differently configured. For example, in some embodiments, a container holder can have a buckle portion that defines a passageway within which a portion of the strap portion 522 can be disposed within prior to being fastened to a protrusion (e.g., protrusion 536, 537).

In another embodiment, the accessory includes a hammock 540 (FIG. 14A and 14B), which can be coupled (e.g., vi snap hooks 542, 544) to a sling described herein, via an attachment system described herein (e.g., an attachment system that includes loops and/or rings). The hammock 540 includes a membrane 546 disposed at least partially, and optionally continuously, between the snap hooks 542, 544 positioned at opposing end portions to form the hammock 540. The membrane 546 can optionally have one or more pockets 548 on an outer surface thereof. The membrane 546 can be flexible, and can optionally be constructed of a net, mesh, or otherwise porous material. As will be understood by one skilled in the art, a number hooks and clips may be used to attach an accessory directly to the sling, or to an attachment system coupled to the sling.

As will be understood by one skilled in the art, the accessories of the present disclosure may be constructed from any number of materials, including but not limited to, plastic, steal, metal, wood, cork, silicon, fabric, leather, rubber, compressible material, for example foam rubber, and/or combinations thereof.

The versatile sling of the present disclosure may be worn over or under a garment. In some embodiments, the sling is incorporated into a garment, for example a uniform. The disclosed versatile sling may be useful in a number of professions that require lifting or carrying items or heavy equipment, persons, or animals, for example those involved in search and rescue, child or elderly care, nurses, doctors, veterinarians, physical and occupational therapists, postal workers, and movers. The disclosed versatile sling may also be useful for a number of day to day activities and hobbies, for example, hiking, backpacking, camping, hunting, fishing, dog walking, shopping, and caring for children.

The disclosed versatile sling may be customized for the size and shape of the wearer. Additionally, when carrying a child or item, the wearer of the sling is able to fully control how much weight is transferred to the shoulder and torso region, and may transfer or shift the item or child to the opposite arm and still achieve the same weight distributing benefit without having to reconfigure the sling, by grasping a handle accessory attached to the hub with the same arm carrying the item or child.

EXAMPLES

The following examples are provided to illustrate further the various applications of the present disclosure and are not intended to limit the disclosure beyond the limitations set forth in the appended claims.

Example 1

Wearing the Versatile Sling

Figure 15:
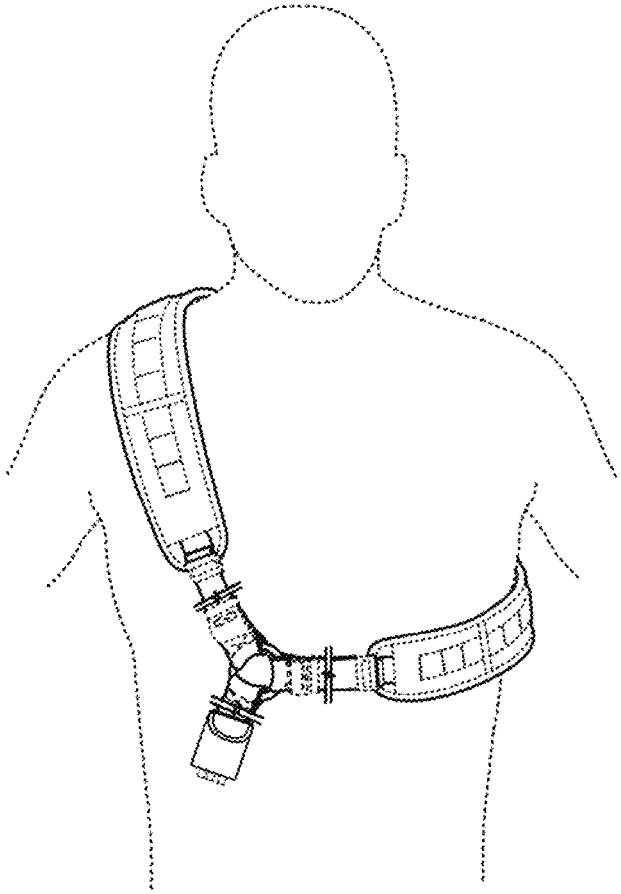
FIG. 15 is a front view of a person wearing a versatile sling, according to an embodiment.

As shown in FIG. 15, the sling can be worn cross-body style, over one shoulder and under the opposite arm with the strap laying across one's torso. As shown in FIG. 15, the sling is worn over the right shoulder, however as will be understood by one skilled in the art the sling may also be worn over the left shoulder. Additionally, while shown with a hub suspended over the abdomen, the sling may be shifted so that the hub is suspended on the side, below an armpit, or on a person's back, depending on the wearers preference and/or the item(s) attached and/or being carried. In some embodiments, the versatile sling (e.g., sling 101) can be devoid of any buckle or other fastener that permits the sling to be moved to a non-looped configuration. Thus, the versatile sling can be donned by the user by slipping the sling over the head and placing one arm through the sling such that the sling is worn cross-body style. In other embodiments, a versatile sling can include such a buckle or fastener that permits the sling to be selectively moved from a looped to a non-looped configuration, or vice versa. In such embodiments, the versatile sling can be donned by the user by placing the sling around the desired body portions and then fastening the buckle or fastener, or the sling can be buckled or fastened and donned in a similar manner as described above for a looped versatile sling (e.g., sling 101).

Example 2

Using the Versatile Sling While Carrying a Child

Shown in FIG. 16A is an example of how a versatile sling 161 of the present disclosure may be used while carrying a child or infant. As shown in FIG. 16A, the sling 161 is worn by an individual cross-body style, over one shoulder and under the opposite arm. A rod-shaped handle accessory is attached to the hub and is grasped with the hand of the arm in which the child sits. This allows some of the weight of the child to be transferred to the wearer's shoulder and torso region, thereby reducing fatigue on the arm carrying the child.

While the individual shown in FIG. 16A is wearing the sling over the right shoulder and carrying the child in the right arm, the same benefit of weight distribution can be achieved even if the child is carried in the left arm, as long as the left hand grasps the handle attached to the sling. Similarly, the sling may be worn over the left shoulder, and the child carried in the left or right arm.

Also shown in FIG. 16A and 16B is an alternate version of the coupling system for the first end and second end of the strap, wherein an eyelet or grommet 167 is used. Further shown by FIGS. 16A and 16B is an alternate hub, comprising a screw cap 163, and a rod handle accessory 165.

Example 3

Using the Versatile Sling While Carrying a Bag

Similar to how a child or infant is carried using the sling, a portion of the weight of a bag or otherwise heavy item may be transferred to the wearer's torso and shoulder region in the same fashion, thereby reducing fatigue on the arm carrying the bag. In addition to carrying the bag in one's arm, a bag may also be attached to an accessory on the hub, or coupled to an attachment system on the sling.

Example 4

Using the Versatile Sling to Carry a Child Using the Hammock Accessory

Figure 14A:
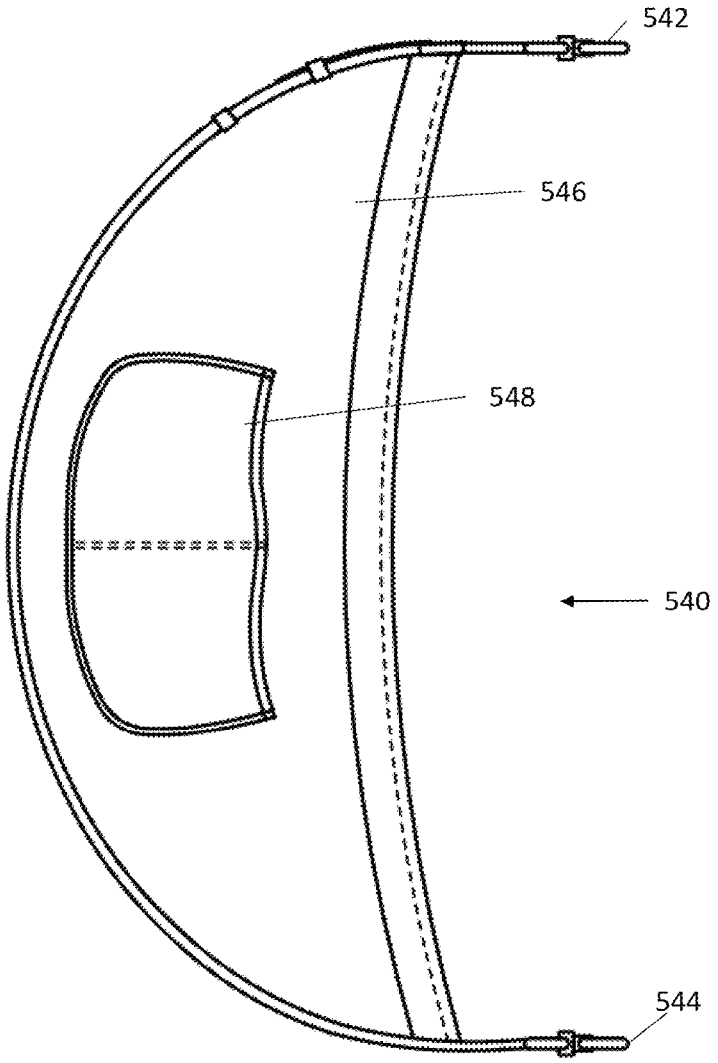
FIG. 14A is a side view of a hammock accessory, according to an embodiment.
Figure 14B:
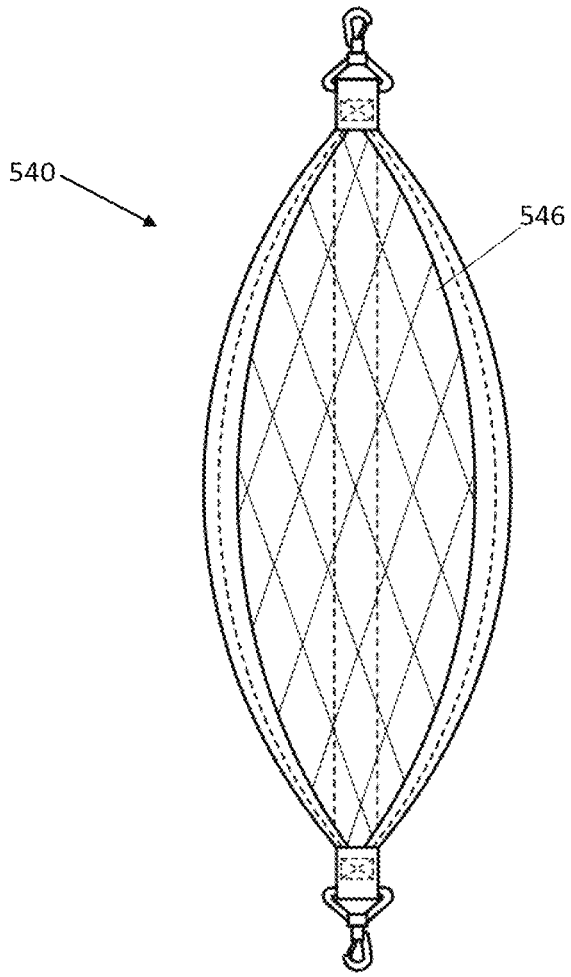
FIG. 14B is a top view of the hammock accessory shown in FIG. 14A.

The hammock accessory shown in FIGS. 14A and 14B can be attached to the versatile sling using an attachment system, for example clasping the snap hooks to one or more series of loops or rings coupled to the sling. The child lays in the hammock and is carried hands-free, while their weight is distributed to the shoulder and torso of the wearer.

Example 5

Using the Versatile Sling While Walking a Dog

Using the leash accessory, an example of which is shown in FIGS. 11A and 11B, the wearer can walk a dog hands free. The sling distributes the force or shock an animal, such as a dog, exerts by pulling or yanking on the leash. Additional loop handles on the leash allow the wearer additional control. The leash may further comprise sections of elastic material for additional give.

Example 6

Using the Versatile Sling for Multiple Purposes

The versatile sling of the present disclosure allows the wearer to carry and/or attach multiple items. For example, one may use the leash accessory to walk a dog, while also using the beverage holder attachment to carry a water bottle, all completely hands-free. A person carrying a child or bag and grasping a handle attachment in the front may also have a backpack coupled to an attachment system on the sling on their back. Moreover, if using the rod handle with the loop on the end (FIG. 9), a second child may grasp the loop and be guided by the wearer. Larger items such as surfboards, coolers, bikes, and sporting equipment may also be configured to be carried hands-free by the versatile sling using various accessories and attachment systems. For example, skies and poles may be positioned to be carried on the wearer's back, while on the front a carabiner is clipped to a loop and is attached to a shopping bag. Thus, using the versatile sling the wearer is able to carry the bag, skies, and poles completely hands-free.

Figure 17A:
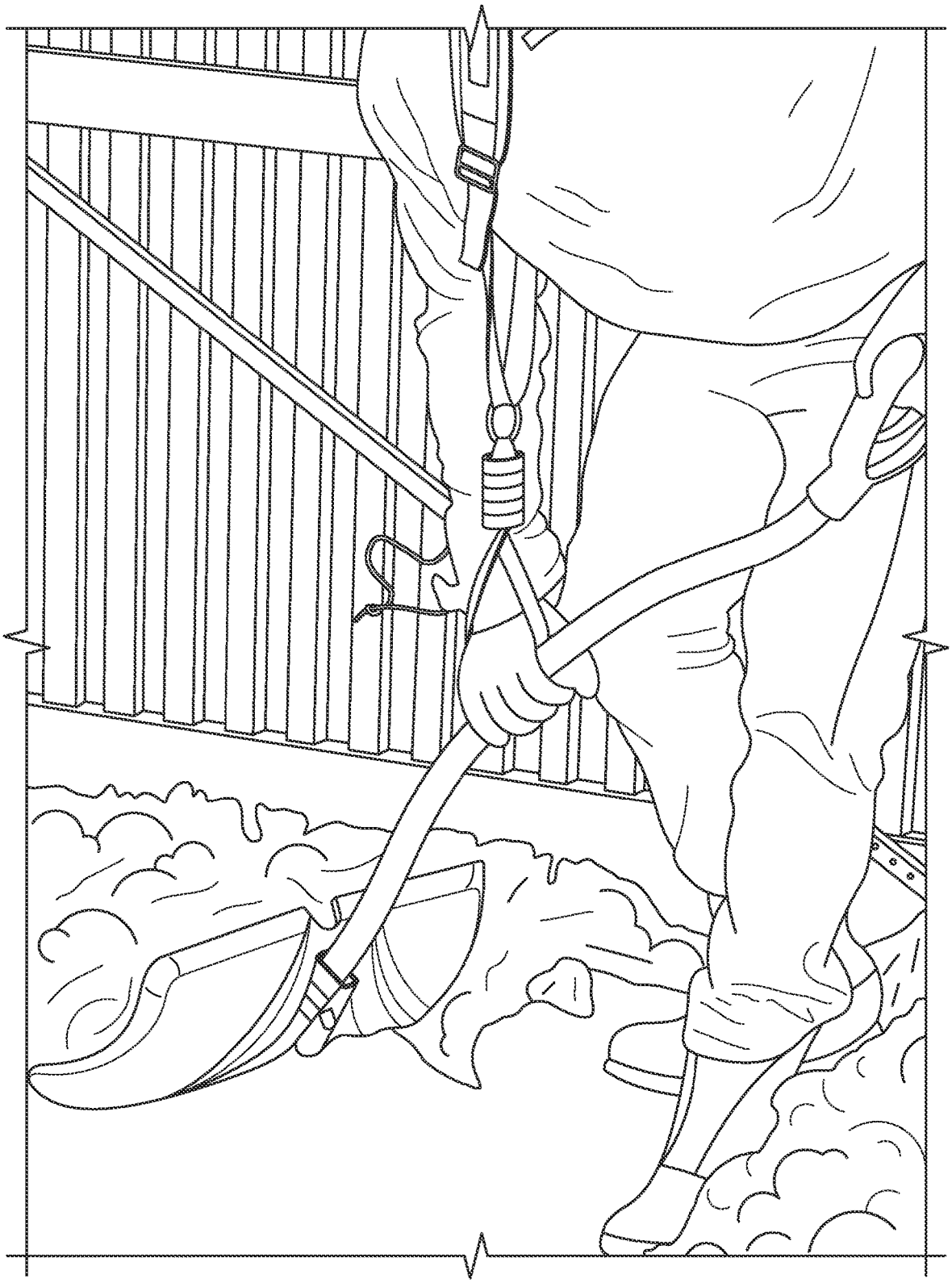
FIG. 17A is a perspective view of a person wearing a versatile sling, according to an embodiment, and using the loop handle accessory to shovel snow.
Figure 17B:
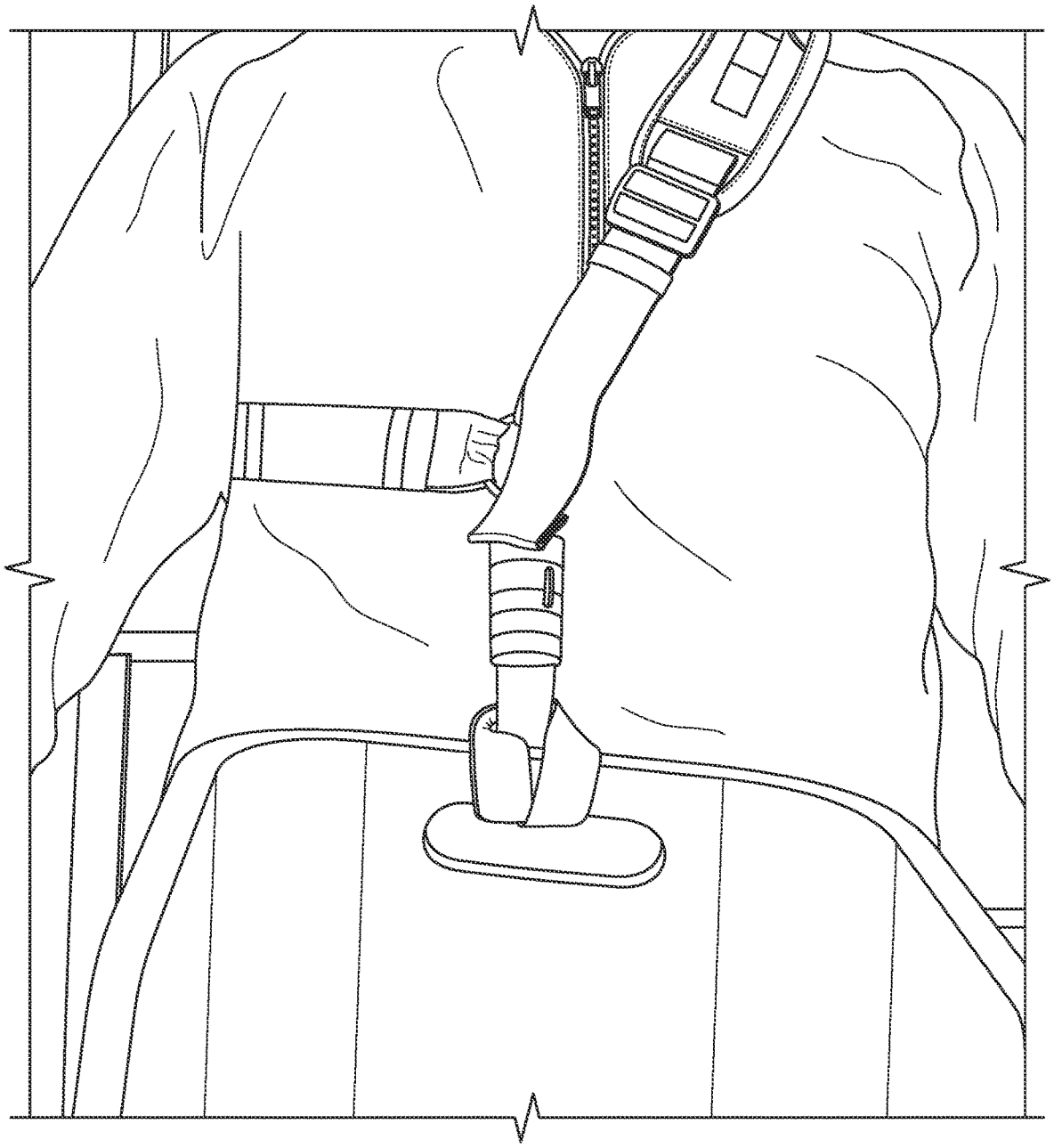
FIG. 17B is a front view of a person wearing a versatile sling, according to an embodiment, and using the loop handle accessory to carry a chair.

A user may also use the loop accessory (for example, shown in FIG. 9B) to help distribute some of the force or weight of an item they're holding or picking up. See for example FIG. 17A. In this example, the user has their hand through the loop, then a shovel handle is grasped with the same hand and the sling system is able to distribute some of the weight of the snow on the shovel from the arm and hand to the shoulder and torso region. The loop accessory may also be looped around an object, such as the chair shown in FIG. 17B. As will be understood by those skilled in the art, the loop accessory may also be looped around things like a bicycle or shopping bag, for example.

The foregoing description has been presented for purposes of illustration and description. It is not intended to be exhaustive or to limit the disclosure to the precise form shown and described, and other modifications and variations may be possible in light of the above teachings. The embodiment was chosen and described in order to best explain the principles and its practical application to thereby enable others skilled in the art to best utilize the versatile sling and various modifications as are suited to the particular use contemplated. It is intended that the appended claims be construed to include other alternative embodiments insofar as limited by the prior art.

NUMBERED EMBODIMENTS

1. A system comprising:
   a strap having a first end, a second end, a width, and an adjustable length, the first end of the strap and the second end of the strap being coupled such that the strap forms a loop;
   a hub coupled to the strap such that the hub is suspended from the loop, the hub configured to releasably attach at least one accessory to the hub; and
   at least one accessory, the at least one accessory characterized by a handle and/or a leash configured to attach to the hub;
   the system configured to allow the wearer of the strap to transfer at least a portion of the weight and/or force of an item or animal being carried by the wearer and/or attached to the at least one accessory to the torso and shoulder of the wearer.
2. The system of embodiment 1, wherein the hub, the first end of the strap, and the second end of the strap are coupled by a substantially circular shaped ring.
3. The system of embodiment 2, wherein the hub, the first end of the strap, and the second end of the strap are coupled by a circle.
4. The system of embodiment 1, wherein the hub, the first end of the strap, and the second end of the strap are coupled by a D-ring.
5. The system of embodiment 1, wherein the hub, the first end of the strap, and the second end of the strap are coupled by a polygon.

6. The system of embodiment 5, wherein the polygon is a triangle, rectangle, square, pentagon, hexagon, heptagon, octagon, nonagon, or decagon.
7. The system of embodiment 1, wherein the strap includes an attachment system coupled to the strap, the attachment system including at least one of a loop, ring, button, hook-and-loop fastener, and/or zipper.
8. The system of embodiment 7, wherein the attachment system comprises a plurality of loops.
9. The system of embodiment 7, wherein the attachment system comprises a plurality of rings.
10. The system of embodiment 7, wherein the attachment system comprises a plurality of buttons.
11. The system of embodiment 7, wherein the attachment system comprises a plurality of hook-and-loop fasteners.
12. The system of embodiment 7, wherein the attachment system comprises a plurality of zippers.
13. The system of any one of embodiments 1-12, wherein the hub comprises a screw cap.
14. The system of claim 13, wherein the screw cap has a locking mechanism.
15. The system of any one of embodiments 1-12, wherein the hub comprises a carabiner.
16. The system of any one of embodiments 1-12, wherein the hub comprises:
   a proximal end, the proximal end suspended from the loop;
   a distal end, the distal end having a recess configured to receive an accessory having a protrusion with a plurality of teeth extending from the outer perimeter of the protrusion; and
   a middle, the middle comprising a locking mechanism, wherein the locking mechanism retains an accessory to the hub by a rotatable element that encircles the protrusion below the plurality of teeth.
17. The system of embodiment 16, wherein the outer surface of the hub includes two or more notches, wherein the notches are aligned when the hub is in the locked position.
18. The system of any one of the preceding embodiments, wherein the strap is constructed of a flexible material, the flexible material including a fabric, leather, nylon, rope, plastic, and/or combinations thereof.
19. The system of embodiment 18, wherein the fabric is reflective.
20. The system of any one of the preceding embodiments, wherein the handle includes a rod, loop, hook, clip, carabiner, or combinations thereof.
21. The system of embodiment 20, wherein the handle is a rod coupled to a loop.
22. The system of any one of embodiments 1-19, wherein the leash is a dog leash.
23. The system of any one of the preceding embodiments, wherein the maximum width of the strap is approximately 5 inches and the minimum width of the strap is approximately 2 inches.
24. The system of any one of the preceding embodiments, wherein the length of the strap is adjustable via at least one buckle.
25. The system of any one of the preceding embodiments, wherein the strap is padded.
26. The system of any one of the preceding embodiments, wherein the strap is incorporated into a garment.
27. The system of embodiment 26, wherein the garment is a uniform.
28. An apparatus, comprising:
   a strap having a first end, a second end, a width, and an adjustable length, the first end of the strap being coupled to the second end of the strap to form a loop; and
   a hub having a proximal end and a distal end, the proximal end of the hub being coupled to the strap such that the hub is suspended from the loop, the distal end of the hub configured to be releasably attached to an accessory.
29. The apparatus of embodiment 28, wherein the hub is a screw cap.
30. The apparatus of embodiment 29, wherein the hub further comprises a locking mechanism.
31. The apparatus of embodiment 28, wherein the distal end of the hub further comprises a recess configured to receive an accessory having a protrusion with a plurality of teeth extending from the outer perimeter of the protrusion.
32. The apparatus of embodiment 31, wherein the hub further comprises a middle, the middle comprising a locking mechanism, wherein the locking mechanism retains an accessory to the hub by a rotatable element that encircles the protrusion below the plurality of teeth.
33. The apparatus of embodiments 30 or 32, wherein the outer surface of the hub includes two or more notches, wherein the notches are aligned when the hub is in the locked position
34. The apparatus of any one of the preceding embodiments, wherein the strap comprises:
   a first elongate flexible member having a length, a width, an outer surface, and an inner surface, and
   a second elongate flexible member having a length, a width, an outer surface and an inner surface, the width of the second elongate flexible member being less than the width of the first elongate flexible member,
   and wherein the second elongate member is coupled to the outer surface of the first elongate flexible member to form a plurality of loops.
35. The apparatus of embodiment 34, wherein the second elongate flexible member is coupled to the outer surface of the first elongate flexible member substantially along a centerline of the first elongate flexible member.
36. The apparatus of embodiment 34 or 35, wherein the first elongate flexible member is padded.
37. The apparatus of any one of the preceding embodiments, wherein the strap is constructed of fabric, leather, nylon, rope, plastic, and/or combinations thereof.
38. The apparatus of embodiment 37, wherein the fabric is reflective.
39. The apparatus of any one of the preceding embodiments, wherein the first end of the strap, the second end of the strap, and the hub, are coupled by a substantially circular shaped ring.
40. The apparatus of embodiment 39, wherein the hub, the first end of the strap, and the second end of the strap are coupled by a circle.
41. The apparatus of any one of embodiments 28-38, wherein the hub, the first end of the strap, and the second end of the strap are coupled by a D-ring.
42. The apparatus of any one of embodiments 28-38, wherein the hub, the first end of the strap, and the second end of the strap are coupled by a polygon.
43. The apparatus of embodiment 42, wherein the polygon is a triangle, rectangle, square, pentagon, hexagon, heptagon, octagon, nonagon, or decagon.

44. The apparatus of any one of the preceding embodiments, wherein the maximum width of the strap is approximately 5 inches and the minimum width of the strap is approximately 2 inches.
45. The apparatus of any one of the preceding embodiments, wherein the strap includes an attachment system coupled to the strap, the attachment system including at least one of a loop, ring, button, hook-and-loop fastener, and/or zipper.
46. The apparatus of embodiment 45, wherein the attachment system comprises a plurality of loops.
47. The apparatus of embodiment 45, wherein the attachment system comprises a plurality of rings.
48. The apparatus of embodiment 45, wherein the attachment system comprises a plurality of buttons.
49. The apparatus of embodiment 45, wherein the attachment system comprises a plurality of hook-and-loop fasteners.
50. The apparatus of embodiment 45, wherein the attachment system comprises a plurality of zippers.
51. The apparatus of any one of the preceding embodiments, wherein the length of the strap is adjustable via at least one buckle.
52. The system of any one of claims 1-27 or the apparatus of any one of claims 28-51, wherein the strap is curved.
53. A hub, comprising:
a proximal end, the proximal end configured to allow coupling to a first object;
a distal end, the distal end having a recess configured to receive a second object, the second object having a protrusion with a plurality of teeth extending from the outer perimeter of the protrusion; and
a middle, the middle comprising a locking mechanism, wherein the locking mechanism retains the second object to the hub via a rotatable element that encircles the protrusion below the plurality of teeth.
54. The hub of embodiment 53, wherein the distal end further comprises at least one elongate protrusion.
55. The hub of embodiment 54, wherein the distal end comprises three elongate protrusions.
56. The hub of any one of the preceding embodiments, wherein the outer surface of the distal end and the outer surface of the middle each include at least one notch, wherein the notches are aligned when the hub is in the locked position.
57. The hub of any one of the preceding embodiments, wherein the hub is constructed of metal, plastic, and/or combinations thereof.

What is claimed is:

1. A versatile sling system comprising:
a strap having a first end, a second end, a width, and an adjustable length, the first end of the strap and the second end of the strap being coupled such that the strap forms a loop;
a hub coupled to the strap such that the hub is suspended from the loop, wherein the hub comprises a proximal end, a distal end, and a middle, the proximal end of the hub being coupled to the loop; and
at least one accessory releasably attachable to the distal end of the hub, wherein the at least one accessory has a protrusion with a plurality of teeth extending from the outer perimeter of the protrusion, the distal end of the hub having a recess configured to receive the protrusion, the middle of the hub including a locking mechanism, wherein the locking mechanism retains the accessory to the hub by a rotatable element that encircles the protrusion below the plurality of teeth;
the system, with the at least one accessory releasably attached to the hub, configured to allow a wearer of the strap to transfer, via the at least one accessory, at least a portion of the weight and/or force of an item or animal to the torso and/or shoulder of the wearer.

2. The system of claim 1, wherein the hub, the first end of the strap, and the second end of the strap are coupled by a ring.

3. The system of claim 1, wherein the strap includes an attachment system coupled to the strap, the attachment system including at least one of a loop, ring, button, hook-and-loop fastener, and/or zipper.

4. The system of claim 1, wherein the strap is constructed of a flexible material, the flexible material including a fabric, leather, nylon, rope, plastic, and/or combinations thereof.

5. The system of claim 1, wherein the at least one accessory includes a rod, loop, hook, clip, carabiner, or combinations thereof.

6. The versatile sling system of claim 1, wherein the distal end of the hub further comprises at least one elongate protrusion.

7. The versatile sling system of claim 1, wherein the outer surface of the distal end and the outer surface of the middle of the hub each include at least one notch, wherein the notches are aligned when the hub is in the locked position.

8. A versatile sling apparatus, comprising:
a strap having a first end, a second end, a width, and an adjustable length, the first end of the strap being coupled to the second end of the strap to form a loop; and
a hub having a proximal end, a distal end, and a middle, the proximal end of the hub being coupled to the strap such that the hub is suspended from the loop, the distal end of the hub configured to receive an accessory having a protrusion with a plurality of teeth extending from the outer perimeter of the protrusion; and the middle including a locking mechanism that retains the accessory to the hub by a rotatable element that encircles the protrusion below the plurality of teeth.

9. The apparatus of claim 8, wherein the strap comprises:
a first elongate flexible member having a length, a width, an outer surface, and an inner surface, and
a second elongate flexible member having a length, a width, an outer surface and an inner surface, the width of the second elongate flexible member being less than the width of the first elongate flexible member,
and wherein the second elongate member is coupled to the outer surface of the first elongate flexible member to form a plurality of loops.

10. The apparatus of claim 9, wherein the second elongate flexible member is coupled to the outer surface of the first elongate flexible member along a centerline of the first elongate flexible member.

11. The apparatus of claim 9, wherein the first elongate flexible member is padded.

12. The apparatus of claim 8, wherein the strap is constructed of fabric, leather, nylon, rope, plastic, and/or combinations thereof.

13. The apparatus of claim 8, wherein the first end of the strap, the second end of the strap, and the hub, are coupled by a ring.

14. The apparatus of claim 8, wherein the maximum width of the strap is approximately 5 inches and the minimum width of the strap is approximately 2 inches.

15. The apparatus of claim 8, wherein the strap includes an attachment system coupled to the strap, the attachment system including at least one of a loop, ring, button, hook-and-loop fastener, and/or zipper.

16. The apparatus of claim 8, wherein the length of the strap is adjustable via at least one buckle.

17. The versatile sling apparatus of claim 8, wherein the distal end of the hub further comprises at least one elongate protrusion.

18. The versatile sling apparatus of claim 8, wherein the outer surface of the distal end and the outer surface of the middle of the hub each include at least one notch, wherein the notches are aligned when the hub is in the locked position.

19. A hub, comprising:

a proximal end, the proximal end configured to allow coupling to a first object;

a distal end, the distal end having a recess configured to receive a second object, the second object having a protrusion with a plurality of teeth extending from the outer perimeter of the protrusion; and a middle, the middle comprising a locking mechanism, wherein the locking mechanism retains the second object to the hub via a rotatable element that encircles the protrusion below the plurality of teeth.

20. The hub of claim 19, wherein the distal end further comprises at least one elongate protrusion.

21. The hub of claim 19, wherein the outer surface of the distal end and the outer surface of the middle each include at least one notch, wherein the notches are aligned when the hub is in the locked position.

* * * * *